US009811022B2

(12) United States Patent
Okada

(10) Patent No.: US 9,811,022 B2
(45) Date of Patent: Nov. 7, 2017

(54) IMAGE FORMING APPARATUS HAVING DEVELOPMENT CONTRAST CONTROL

(71) Applicant: CANON KABUSHIKI KAISHA, Tokyo (JP)

(72) Inventor: Noriyuki Okada, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/056,050

(22) Filed: Feb. 29, 2016

(65) Prior Publication Data

US 2016/0195832 A1 Jul. 7, 2016

Related U.S. Application Data

(63) Continuation of application No. PCT/JP2017/073846, filed on Sep. 3, 2014.

(30) Foreign Application Priority Data

Sep. 3, 2013 (JP) ..... 2013-182008

(51) Int. Cl.
*G03G 15/08* (2006.01)
*G03G 15/06* (2006.01)
*G03G 15/09* (2006.01)

(52) U.S. Cl.
CPC ..... *G03G 15/065* (2013.01); *G03G 15/0849* (2013.01); *G03G 15/09* (2013.01)

(58) Field of Classification Search
CPC ..... G03G 15/065; G03G 15/09
(Continued)

(56) References Cited

U.S. PATENT DOCUMENTS 6,999,689 B2 2/2006 Kinoshita et al.
7,561,831 B2 7/2009 Naoi et al.
(Continued)

FOREIGN PATENT DOCUMENTS

CN 103246187 A 8/2013
EP 0 536 050 A2 4/1993
(Continued)

OTHER PUBLICATIONS

PCT International Search Report and the Written Opinion dated Dec. 2, 2014.
(Continued)

*Primary Examiner* — Quana M Grainger
(74) *Attorney, Agent, or Firm* — Fitzpatrick, Cella, Harper & Scinto

(57) ABSTRACT

An image forming apparatus includes an image bearing member configured to carry an image, a developing device configured to develop a latent image with a developer including toner and carrier, and a toner content sensor configured to detect a ratio of the toner to the developer in the developing device. A toner container contains the toner to be supplied to the developing device, and a notifying portion notifies necessity for exchange of the toner container when the ratio indicated by the output of the sensor reaches a set level lower than the predetermined range. A controller controls an image forming condition so as to change, on the basis of the output of the toner content sensor, a development contrast wherein the controller sets the development contrast at a level higher than that when the ratio is in the predetermined range, at least in part of a period from when the ratio indicated by the output of the toner content sensor becomes lower than the predetermined range to when the ratio indicated by the output of the toner content sensor reaches a first set level.

18 Claims, 14 Drawing Sheets

(58) Field of Classification Search
USPC ..... 399/46
See application file for complete search history.

(56) References Cited

U.S. PATENT DOCUMENTS

| | | | | |
|---|---|---|---|---|
| 8,121,499 | B2 | 2/2012 | Fujiwara | |
| 8,805,221 | B2 | 8/2014 | Okada | |
| 9,170,527 | B2 | 10/2015 | Ariizumi | |
| 2007/0047981 | A1 | 3/2007 | Ishida | |
| 2008/0285993 | A1* | 11/2008 | Ishida | G03G 15/0283 399/58 |
| 2009/0297229 | A1* | 12/2009 | Tomizawa | G03G 15/09 399/274 |
| 2010/0272453 | A1* | 10/2010 | Fujiwara | G03G 15/065 399/27 |
| 2011/0280594 | A1* | 11/2011 | Tanaka | G03G 15/065 399/27 |
| 2012/0207497 | A1* | 8/2012 | Gomi | G03G 15/065 399/49 |
| 2012/0230707 | A1* | 9/2012 | Shigehiro | G03G 15/0851 399/27 |

FOREIGN PATENT DOCUMENTS

| | | | |
|---|---|---|---|
| JP | H01-035344 | B2 | 7/1989 |
| JP | 04-242766 | A | 8/1992 |
| JP | 05-053424 | A | 3/1993 |
| JP | 07-191506 | A | 7/1995 |
| JP | 2005-017713 | A | 1/2005 |
| JP | 2005-062848 | A | 3/2005 |
| JP | 2005-345961 | A | 12/2005 |
| JP | 2006-221114 | A | 8/2006 |
| JP | 2007-078896 | A | 3/2007 |
| JP | 2010-002537 | A | 1/2010 |
| JP | 2010-271692 | A | 12/2010 |
| JP | 2013-160909 | A | 8/2013 |

OTHER PUBLICATIONS

European Search Report dated Mar. 17, 2017, in related European Patent Application No. 14841894.0.
Japanese Office Action dated Jun. 6, 2017, in related Japanese Patent Application No. 2013-182008.
Chinese Office Action dated Jul. 26, 2017, in related Chinese Patent Application No. 201480048505.3 (with English translation).

* cited by examiner

IMAGE FORMING APPARATUS HAVING DEVELOPMENT CONTRAST CONTROL

[TITLE OF THE INVENTION] IMAGE FORMING APPARATUS

This application is a continuation of PCT Application No. PCT/JP2014/073846, filed on Sep. 3, 2014.

FIELD OF THE INVENTION

The present invention relates to an image forming apparatus, the developing section of which forms an image with the use of developer which contains toner and carrier.

BACKGROUND ART

There have been widely used image forming apparatuses which have an image bearing component, an exposing section, a developing section, a transferring section, and a fixing section, and in which the exposing section forms an electrostatic image on the image bearing component; the developing section develops the electrostatic latent image into a toner image with the use of developer which contains toner and carrier; the transferring section transfers the toner image onto a sheet of recording medium; and the fixing section fixes the toner image to a sheet of recording medium by the application of heat and pressure. As an image forming operation continues, toner consumption continues. Consequently, the developer in the developing section reduces in TD ratio (toner density: weight ratio of toner in developer). As the developer reduces in TD ratio, the developer supplying section supplies the developing section with replenishment developer which contains toner.

Japanese Laid-open Patent Application No. 2005-62848 discloses an image forming apparatus, the developing section of which is provided with an inductance sensor for detecting the TD ratio. In the case of this image forming apparatus, in order to maintain the TD ratio of the developer at a preset level (preset value), the amount by which the replenishment developer is supplied to the developing section from a replenishment developer container is adjusted according to the output of the induction sensor. As the TD ratio of the developer falls below the preset level, the control section of the apparatus determines that the replenishment developer container has become empty, interrupts the ongoing image forming operation, and displays a message which suggests the need for replacement of the replenishment developer container, on the control panel.

The density of an image which an image forming apparatus outputs corresponds to the amount (weight per unit area) by which toner is adhered to the electrostatic latent image to develop the electrostatic image. The amount by which toner is adhered to an electrostatic image is affected by the state of the image bearing component after the charging of the image bearing component by the charging section, state of the image bearing component after the exposure of the image bearing component by the exposing section, and state of the electrostatic image after the development of the electrostatic image by the developing section.

Japanese Laid-open Patent Application No. 2005-345961 discloses an image forming apparatus equipped with an optical sensor for detecting the amount (per unit area) of toner in the toner image formed on the image bearing component. In the case of this image forming apparatus, an image forming operation is periodically interrupted, and multiple test images (toner images) which are different in the amount of output of the exposing section, are formed. Then, the test images are detected by an optical sensor. Then, the exposing section is adjusted in the amount of output, based on the results of the detection, in order to ensure that the image forming apparatus outputs images which are proper in the amount of toner per unit area.

As the developer in the developing section reduces in the TD ratio, the developing section increases the amount of charge it gives to toner. Consequently, it reduces in the amount by which it adheres toner to an electrostatic image, and therefore, is likely to cause the image forming apparatus to reduce in image density.

Thus, Japanese Laid-open Patent Application No. 2005-62848 proposes an image forming apparatus designed so that as it determines, based on the output of its induction sensor, that the developer has reduced in TD ratio, its replenishment developer supplying section replenishes the developing section with replenishment developer. However, it sometimes occurs that even though the operation for replenishing the developing section with replenishment developer is carried out by the replenishment developer supplying section, the developer in the developing section continues to reduce in TD ratio.

For example, as a replenishment developer container becomes almost empty, even if the replenishment developer supplying section carries out the operation for replenishing the developing section with replenishment developer, the developing section is not supplied with a sufficient amount of toner, and therefore, the developer in the developing section continues to reduce in TD ratio. If the replenishment developer container becomes empty, the developing section is not replenished with toner no matter how long the operation for replenishing the developing section with replenishment developer is continued, and therefore, the developer in the developing section continues to reduce in TD ratio. Consequently, the image forming apparatus continues to reduce in image density, outputting therefore several tens of prints which are inferior in image quality.

SUMMARY OF THE INVENTION

The primary object of the present invention is to provide an image forming apparatus which is capable of preventing the problem that it reduces in image density in a case where the developer in its developing section continues to reduce in TD ratio even though its replenishment developer supplying section continues to carry out the operation for supplying the developing section with replenishment developer.

Solution to Problem

According to an aspect of the invention, there is provided an image forming apparatus comprising an image bearing member configured to carry an image; a developing device configured to develop a latent image formed by exposing said image bearing member electrically charged to light, with a developer including toner and carrier; a sensor configured to detect information relating to an amount of magnetization of the developer per unit volume in said developing device; and a controller configured to control an image forming condition so as to change, on the basis of a detection result of said sensor, a development contrast which is a potential difference between an image portion potential of a maximum image density in the latent image and a development DC bias potential applied to said developing device, wherein said controller controls the image forming condition on the basis of the detection result of said sensor such that when the amount of magnetization of the developer per unit volume in said developing device is a first predetermined value, the development contrast is smaller than that when the amount is a second predetermined value which is larger than the first predetermined value.

According to the present invention, there is provided an image forming apparatus which is capable of preventing the problem that it reduces in image density in a case where the developer in its developing section continues to reduce in TD ratio even though its replenishment developer supplying section continues to carry out the operation for supplying the developing section with replenishment developer.

DESCRIPTION OF THE EMBODIMENTS

Hereinafter, some of the preferred embodiments of the present invention are described in detail with reference to appended drawings.

<Embodiment 1>

(Image Forming Apparatus)

Figure 1:
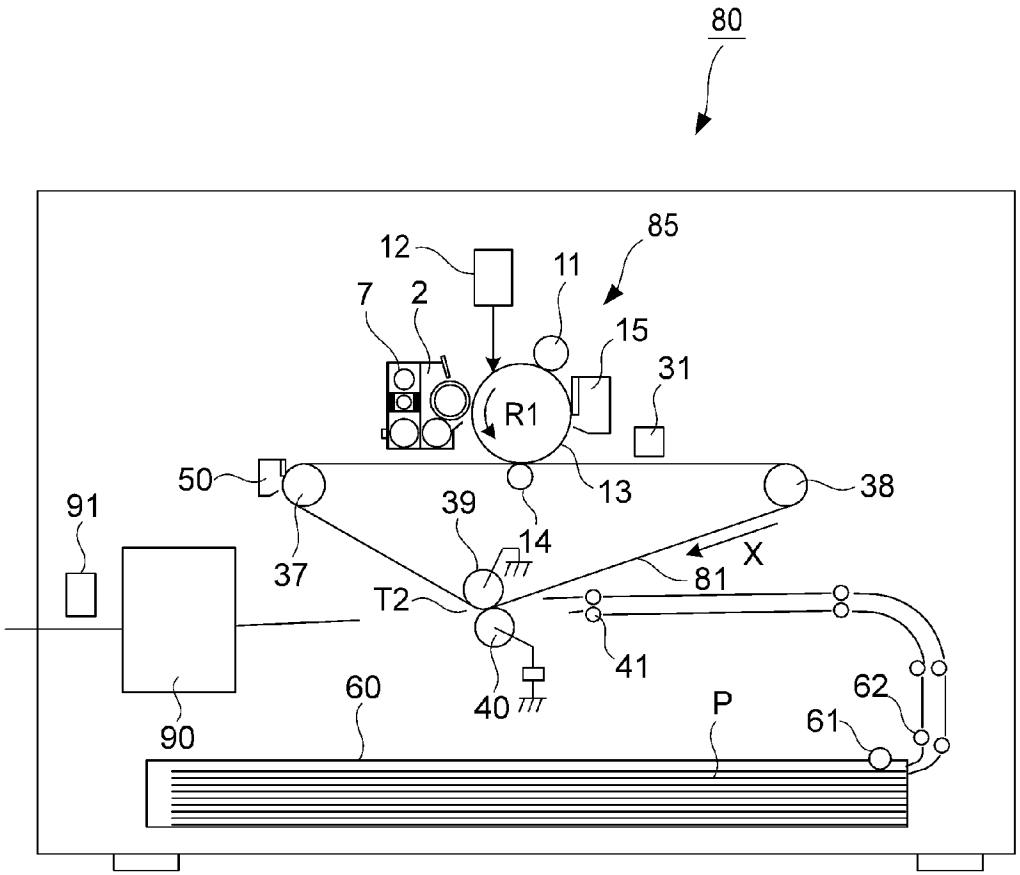
FIG. 1 is a drawing for describing the structure of a typical image forming apparatus to which the present invention is applicable.

FIG. 1 is a drawing for describing the structure of the image forming apparatus in this embodiment. Referring to FIG. 1, the image forming apparatus 80 is a monochromatic printer of the intermediary transfer type, in which its image forming section 85 is disposed on the top side of its intermediary transfer belt 81. The image forming apparatus 80 in this embodiment can output as many as 25 prints of size A4 per minute in the landscape mode.

In the image forming section 85, a toner image is formed on a photosensitive drum 13, and is transferred onto the intermediary transfer belt 81. Then, the toner image on the intermediary transfer belt 81 is conveyed to the secondary transferring section T2, in which the toner image is transferred (secondary transfer) onto a sheet P of recording medium. A separation roller 62 pulls the sheets in a cassette 60 one by one out of a cassette 60, and sends each sheet P to a pair of registration rollers 41, which sends each sheet P to the secondary transferring section T2 with such timing that the sheet P arrives at the secondary transferring section T2 at the same time as the toner image on the intermediary transfer belt 81. After the secondary transfer of the toner image onto the sheet P, heat and pressure are applied to the sheet P and the toner image thereon. Thus, the toner image becomes fixed to the surface of the sheet P.

The intermediary transfer belt 81 is supported by a tension roller 37, an inward secondary transfer roller 39, and a driver roller 38 in such a manner that the intermediary transfer belt 81 bridges between adjacent two rollers. It rotates in the direction indicated by an arrow mark X by being driven by the driver roller 38. The secondary transfer roller 40 forms the secondary transferring section T2 by being placed in contact with the portion of the intermediary transfer belt 81, which is being backed up by the inward secondary transfer roller 39. As positive DC voltage is applied to the secondary transfer roller 40, the toner image on the intermediary transfer belt 81 transfers onto a sheet P of recording medium. The belt cleaning device 50 recovers the transfer residual toner, that is, the toner remaining adhered to the surface of the intermediary transfer belt 81 after the secondary transfer, by rubbing the intermediary transfer belt 81 with its cleaning blade.

(Image Forming Section)

Figure 2:
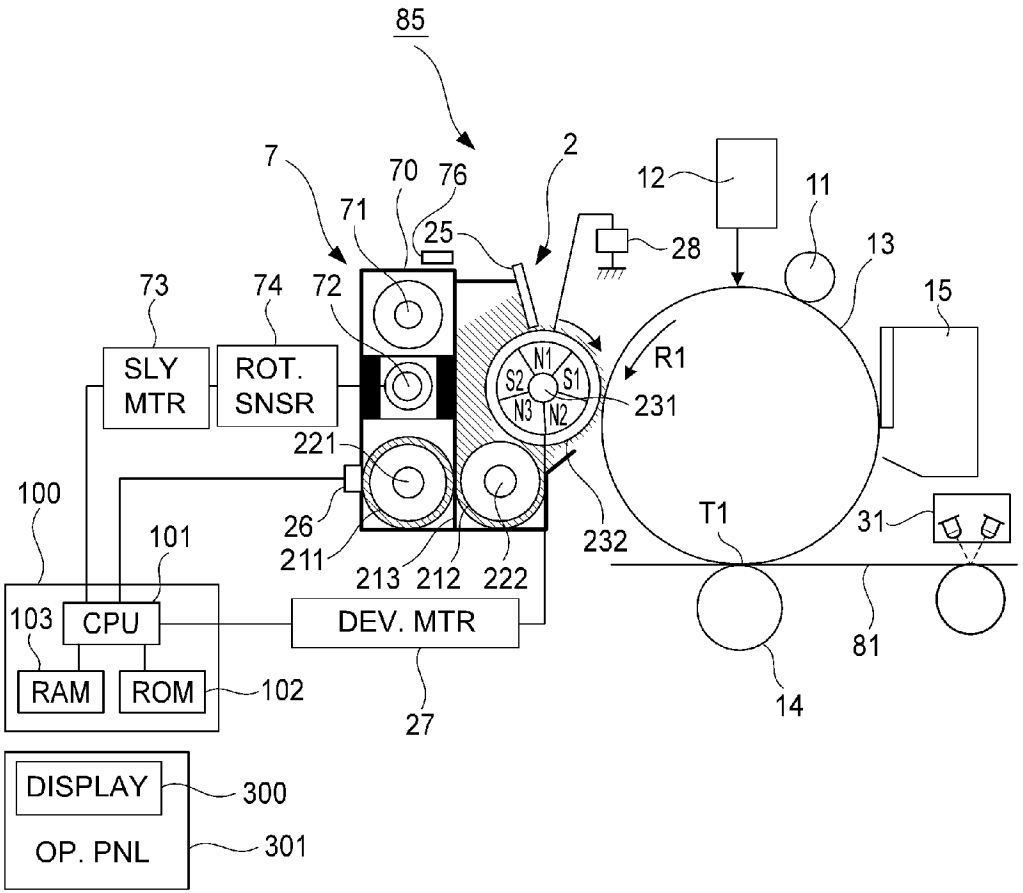
FIG. 2 is a drawing for describing the structure of the image forming section of the image forming apparatus shown in FIG. 1.

FIG. 2 is a drawing for describing the structure of the image forming section. Referring to FIG. 2, the image forming section 85 has the photosensitive drum 13 as an example of an image bearing component. It has also a charging device 11, an exposing device 12, a developing device 2, a transfer roller 14, and a drum cleaning device 15, which are disposed in the adjacencies of the peripheral surface of the photosensitive drum 13. The photosensitive drum 13 comprises an aluminum cylinder, and a photosensitive layer formed on the peripheral surface of the aluminum cylinder. It rotates in the direction indicated by an arrow mark R1 at a process speed of 110 mm/sec.

The charging device 11 negatively and uniformly charges the peripheral surface of the photosensitive drum 13 to a potential level VD (preset potential level) by applying oscillatory voltage, which is a combination of negative DC voltage and AC voltage Vac, to the charge roller. The lengthwise ends of the charge roller are under the pressure generated by unshown springy components in the direction of the photosensitive drum 13. The charge roller is rotated by the rotation of the photosensitive drum 13. For example, the DC voltage Vd is −600 V, and the AC voltage Vac is 1.5 kV in peak-to-peak voltage.

The exposing device 12 writes an electrostatic image of an image to be formed, on the peripheral surface of the photosensitive drum 13, by scanning, with the use of a rotational mirror, the peripheral surface of the photosensitive drum 13, by a beam of laser light it emits while modulating (turning on or off) the beam according to the image formation signals obtained by dividing the image to be formed, into minute cells. As the peripheral surface of the photosensitive drum 13, which has just been charged to −600 V (pre-exposure potential level) is scanned by the exposing device 12, the exposed points of the peripheral surface of the photosensitive drum 13 are discharged by the exposure. Consequently, an electrostatic image is effected, the exposed points of which are 100 V in potential level (post-exposure potential level).

The exposing device 12 is enabled to change the beam of laser light it emits, in intensity, within an intensity range of 0-255, in order to change a given point of the uniformly charged peripheral surface of the photosensitive drum 13, in the potential level at which the given point will be as it is exposed. As the beam of laser light is changed in intensity L within the range of 0-255, the potential level of a given exposed point on the peripheral surface of the photosensitive drum 13 becomes V(L).

The gradation of an image is controlled by area gradation, by controlling the exposing device 12 in the laser beam intensity L, as will be described later. However, the present invention is also applicable to an image forming apparatus which controls image tone by changing the laser power.

The developing device 2 develops the electrostatic image on the photosensitive drum 13 into a visible image (image formed of toner). The lengthwise ends of the transfer roller 14 are kept under the pressure generated by unshown springy components in the direction of the photosensitive drum 13. The transfer roller 14 forms a transferring section T1 between the photosensitive drum 13 and intermediary transfer belt 81 by pressing on the intermediary transfer belt 81. As positive DC voltage is applied to the transfer roller 14, the negatively charged toner image on the photosensitive drum 13 is transferred onto the intermediary transfer belt 81. The drum cleaning device 15 removes the secondary transfer residual toner, that is, the toner remaining on the peripheral surface of the photosensitive drum 13 after the toner image transfer, by rubbing the peripheral surface of the photosensitive drum 13 with its cleaning blade.

(Developing Device)

Referring to FIG. 2, the developing device 2 is of the so-called two-component development type. That is, it uses developer which contains toner (nonmagnetic) and carrier (magnetic). The polarity to which toner is charged is negative, whereas the polarity to which carrier is charged is positive.

The internal space of the developing device 2 has a development chamber 212 and a stirring chamber 211, which are separated by a partition wall 213. The front and rear end portions of the partitioning wall 213 are provided with a pair of developer passages, one for one, which connect between the development chamber 212 and stirring chamber 211.

The development chamber 212 has a development sleeve 232. There is a first conveyance screw 222 on the underside of the development sleeve 232. The first conveyance screw 222 conveys the developer in the development chamber 212 while stirring the developer. It coats the development sleeve 232 with the developer in the development chamber 212 while conveying the developer. As the developer in the development chamber 212 is used for development, the toner in the developer is consumed for the development. Thus, the developer in the development chamber 212 reduces in TD ratio. Then, the developer in the development chamber 212 is moved into the stirring chamber 211 by the first screw 222 through one of the aforementioned developer passages.

The stirring chamber 211 is provided with the second conveyance screw 221. The second conveyance screw 221 conveys a combination of the toner delivered to the stirring chamber 211 from the developer supplying section 7, and the developer in the developing device 2, while stirring the combination, making the developer in the developing device 2 uniform in TD ratio. After the developer in the stirring chamber 211 is restored in TD ratio by being replenished with toner, it is moved into the development chamber 212 by the second conveyance screw 221 through the other developer passage.

The development sleeve 232, first conveyance screw 222, and second conveyance screw 221 are in connection with each other through an unshown gear train. They are driven by a developing device driving motor 27. There is a stationary magnet 231 in the hollow of the development sleeve 232. The magnet 231 is provided with three or more magnetic poles. In this embodiment, the magnet 231 is provided with five magnetic poles.

While the developer in the development chamber 212 is conveyed while being stirred, it is adhered to the peripheral surface of the development sleeve 232 by the magnetic force of the pickup pole N3, and then, is conveyed by the development sleeve 232 as the development sleeve 232 rotates. The developer on the peripheral surface of the development sleeve 232 is conveyed further by the development sleeve 232 while being securely held to the peripheral surface of the development sleeve 232 by the cut pole S2, and forming a magnetic brush. The regulation blade 25 trims the tip portion of the magnetic brush to correct in thickness the developer (developer layer) on the peripheral surface of the development sleeve 232. After being corrected in thickness, the developer (developer layer) is conveyed to the development area of the photosensitive drum 13 by the rotation of the development sleeve 232 while being securely held to the peripheral surface of the development sleeve 232 by the magnetic pole N1. In the development area, the developer on the development sleeve 232 forms a magnetic brush by being held to the peripheral surface of the development sleeve 232 by the development pole S1, and rubs the peripheral surface of the photosensitive drum 13.

A development power source 28 causes the toner in the magnetic brush to transfer onto the electrostatic image on the photosensitive drum 13, by applying oscillatory voltage, which is a combination of DC voltage Vdc (for example, −550 V), and AC voltage Vac (1.3 kVpp), to the development sleeve 232.

As described previously with reference to FIG. 2, the exposing device 12 forms a latent image by exposing the photosensitive drum 13 which is an example of an image bearing component for bearing an image. The developing device 2 develops the latent image formed by exposing the photosensitive drum 13, with the use of the developer which contains toner and carrier, and the potential of which is kept at the development level (DC). The replenishment developer supplying section 7 which is an example of a replenishing device, replenishes the developing device 2 with toner, based on the difference between the value (inductance) detected by the inductance sensor 26, and a preset value, if the value (inductance) detected by the inductance sensor 26 is no more than a preset value.

(Image Density Adjustment Control)

Figure 3:
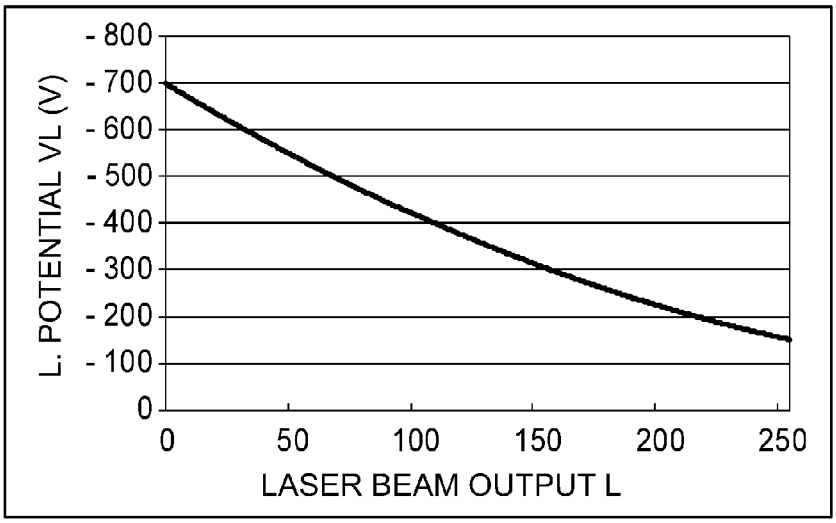
FIG. 3 is a drawing for describing the relationship between the exposure strength of an exposing device and the potential level of a given unexposed point of the electrostatic image formed by the exposure.
Figure 5:
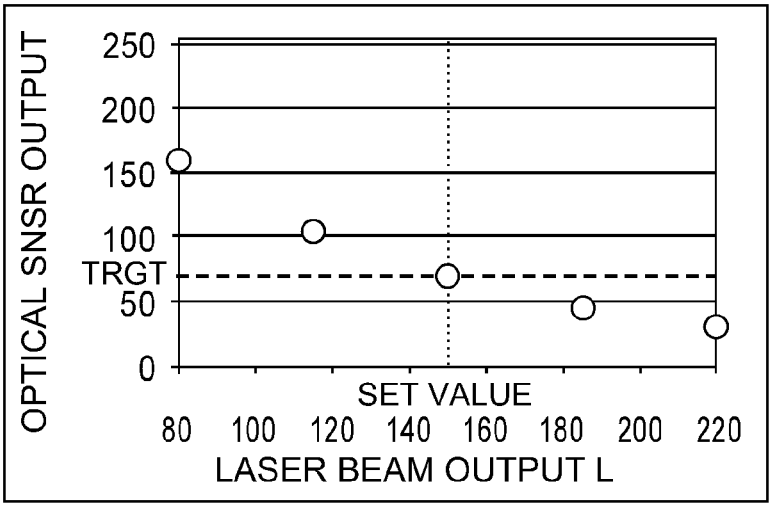
FIG. 5 is a drawing for describing the data obtained in the image density adjustment control sequence.
Figure 14:
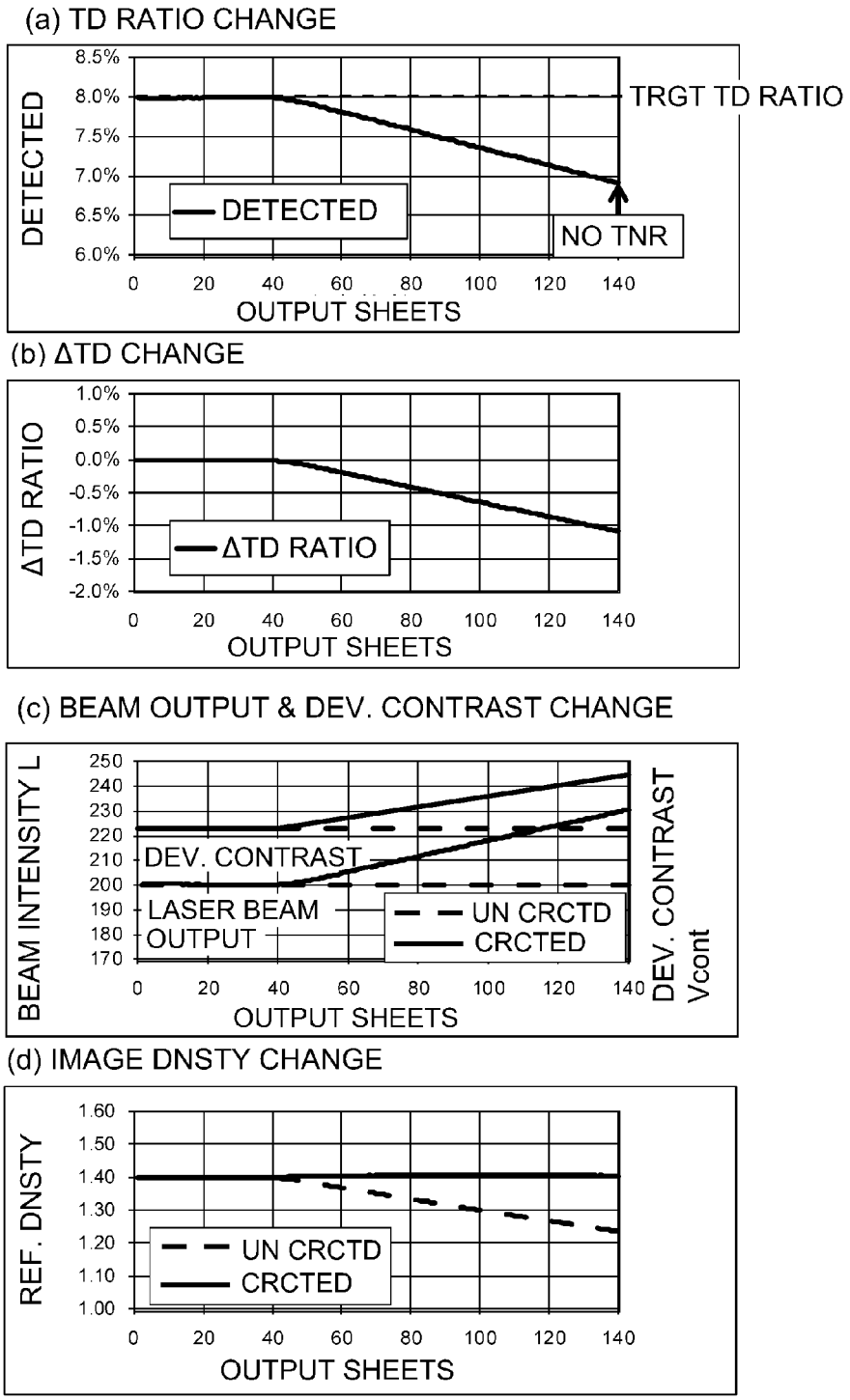
FIG. 14 is a drawing for describing the effects of the second embodiment when the laser output setting is high.

FIG. 3 is a drawing for describing the relationship between the exposure intensity of the exposing device 12 and the potential level of a given exposed point of the peripheral surface of the photosensitive drum 13. FIG. 14 is a drawing for describing a test image (patch) for image density adjustment control. FIG. 5 is a drawing for describing the data obtained by the image density adjustment control sequence.

Referring to FIG. 2, the photosensitive drum 13 is charged to a potential level of −700 V (pre-exposure level), and then, an electrostatic image, the exposed points of which have a potential level of VL, is formed by exposing the photosensitive drum 13 with the exposing device 12. The exposing device 12 can be changed in the intensity of exposure light (laser output), by setting the input to a semiconductor laser element, to one of 256 levels expressed in 8 bits.

Referring to FIG. 3, the greater the input to the semiconductor laser element, the greater the output of the semiconductor laser. The greater the output of the semiconductor laser, the lower in potential level VL, the exposed points of the electrostatic image. When the output L of the semiconductor laser is 0, the value of the potential level VL of an exposed point of the electrostatic image is the same as the value of the potential level VD of an unexposed point of the electrostatic image.

Referring to FIG. 2, the electrostatic image on the photosensitive drum 13 is developed into a toner image, the amount of toner per unit area of which is proportional to the development contrast Vcont, which is the difference between the magnitude of the DC voltage Vdc to be applied to the development sleeve 232, and the value of the potential level VL of an exposed point of the electrostatic latent image (unexposed point of uniformly charged peripheral surface of photosensitive drum 13). The greater the exposing device 12 is made in the output L of the semiconductor laser, the lower in potential level VL, an exposed point of a resultant electrostatic image will be, and therefore, the greater, the development contrast Vcont will be. Therefore, as the exposing device 12 is increased in the output L of the semiconductor laser, the amount by which toner is adhered to the electrostatic latent image on the photosensitive drum 13 to develop the electrostatic image increases.

There is disposed an optical sensor 31 in the immediate adjacencies of the outward surface of the intermediary transfer belt 81. The optical sensor 31 is capable of detecting the amount of toner which the toner image on the intermediary transfer belt 81 has per unit area. It projects a beam of infrared light from its LED toward the intermediary transfer belt 81, and detects the portion of the beam, which was regularly reflected by the toner image on the intermediary transfer belt 81. The greater in the amount of toner per unit area, the toner image, the more, the beam of infrared light from the LED is diffused, and therefore, the smaller the amount by which the beam of infrared light is regularly reflected by the toner image on intermediary transfer belt 81. Thus, the output of the photo-diode corresponds to the amount of toner of the toner image on the intermediary transfer belt 81.

The control section 100 carries out an operation for adjusting the image forming apparatus 80 in image density (Dmax control) by interrupting the ongoing image forming operation. In an operation for adjusting the image forming apparatus 80 in image density (which hereafter may be referred to simply as "image density adjustment control sequence"), test images (test patches) for density detection are formed on the photosensitive drum 13, and are transferred onto the intermediary transfer belt 81. Then, the test images are detected by the optical sensor 31. The control section 100 obtains the amount of toner of each test image per unit area based on the value of the output of the optical sensor 31, and converts the obtained amount of toner into a value which is equivalent to the reflection density of a fixed toner image (converted image density).

The control section 100 sets the output L of the laser so that the converted image density of a test image (toner image) which is highest in density (100% in areal gradation) takes a preset value. The control sequence is referred to as "image density adjustment control sequence (Dmax control sequence)". In consideration of the balance between the stabilization of the image forming apparatus 80 in terms of image density, and the amount of downtime, the control section 100 interrupts an ongoing image forming operation with a frequency of once for every 300 images in order to carry out the image density adjustment control sequence.

Figure 4:
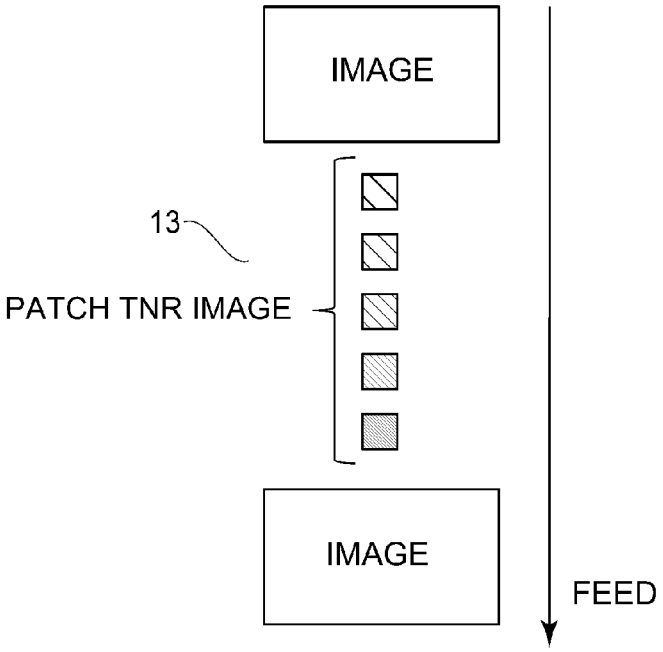
FIG. 4 is a drawing for describing the test image (toner images) formed in an image density adjustment control sequence.

Referring to FIG. 4, five test images for density detection are formed in an extended image interval. The five test images correspond to laser outputs L of 80, 115, 150, 185 and 220 of the developing device 2.

Referring to FIG. 5, as the exposing device 12 is changed in the laser output L to the abovementioned five values, the amount by which toner is adhered to the peripheral surface of the photosensitive drum 13 changes to five different amounts, respectively. Thus, five different output values are obtained from the optical sensor 31. As described above, there is such a relationship between the output of the optical sensor 31 and the amount of toner of the test patch per unit area. That is, the greater, a test image in the amount of toner per unit area, the smaller the amount by which the beam of infrared light is reflected. Thus, the lower, the value of the sensor output, the higher the converted image density.

The control section 100 obtains a value for the laser output L, which corresponds to the target value for the converted image density, based on the relationship between each of the five sensor output values, and the corresponding laser output L, shown in FIG. 5. Then, it sets the laser output of the exposing device 12 to the obtained value. In this embodiment, the laser output L of the exposing device 12 is set so that the target converted image density (maximum density Dmax) becomes 1.4. In a case where the results of the detection (measurement) by the optical sensor 31 are as shown in FIG. 5, the laser output L is set to 150 (L=150).

(Replenishment Developer Supplying Section)

Figure 6:
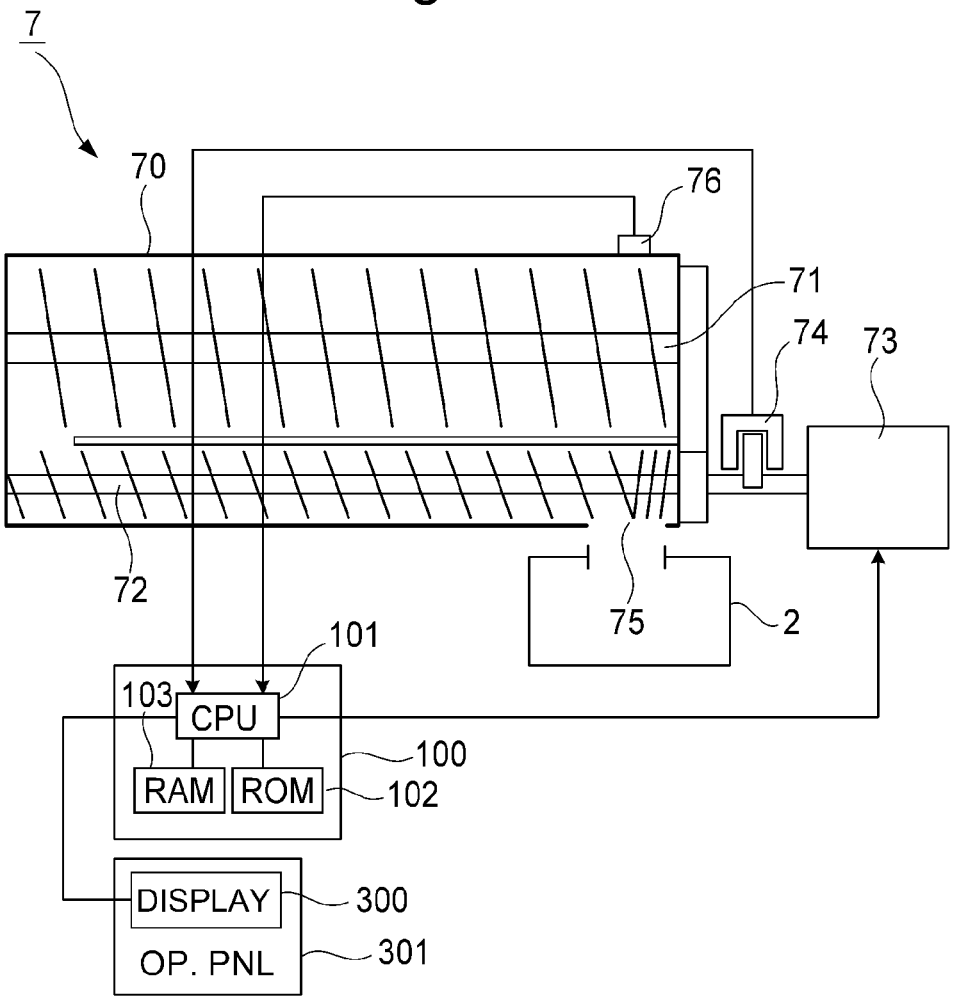
FIG. 6 is a drawing for describing the structure of the replenishment developer supplying section.

FIG. 6 is a drawing for describing the replenishment developer supplying section. Referring to FIG. 2, a toner bottle 70 which is an example of developer container is attached to the replenishment developer supplying section 7 in such a manner that it can be replaced. The toner bottle 70 stores the replenishment developer which is pure (100%) toner. In order to prevent toner from scattering, the replenishment developer is available to a user only in the toner bottle 70 which is sealed by a manufacturer. Thus, when the developing device 4 needs to be replenished with toner, the empty toner bottle in the developing device 2 is to be replaced with a brand-new (sealed) toner bottle 70. There is disposed a toner bottle sensor 76 above the replenishment developer supplying section 7. The control section 100 determines whether the toner bottle 70 is present or absent, and whether the toner bottle 70 in the replenishment developer supplying section 7 needs to be replaced or not.

Referring to FIG. 2, the replenishment developer supplying section 7 replenishes the developing device 2 with the replenishment developer through the replenishment toner entrance (75 in FIG. 6), by rotating the toner conveyance bottom screw 72. As the toner conveyance top screw 71 is rotated, the replenishment developer supplying section 7 moves the replenishment developer supplied from the toner bottle 70. The toner conveyance bottom screw 72 and toner conveyance top screw 71 are in connection to each other through a gear train, and simultaneously rotate by being driven by a replenishment motor 73. The rotation of the replenishment motor 73 is detectable in increments of a full rotation of the toner conveyance bottom screw 72, by a rotation detecting means 74 (photo-interrupter).

(Replenishment Developer Delivery Control)

Referring to FIG. 2, each time an electrostatic image is developed, the developer in the developing device 2 reduces in TD ratio by an amount equivalent to the amount by which the toner is consumed for the development. The control section 100 calculates the amount of toner necessary to develop an electrostatic image. Then, it replenishes the developing device 2 with the replenishment developer (100% in toner content) from the replenishment developer supplying section 7, by an amount equivalent to the calculated amount of toner consumption, in order to restore the developer in the developing device 2 in TD ratio. More concretely, each time an electrostatic image is developed, the control section 100 calculates the amount by which the developing device 2 needs to be replenished with toner, and rotates the replenishment motor 73 by an amount equivalent to the calculated amount by which the developing device 2 needs to be replenished with toner.

However, it is possible that there will be a difference between the amount by which the developing device 2 is replenished with the replenishment developer based on the calculated amount of toner consumption per electrostatic image, and the actual amount by which toner was consumed per electrostatic image. Thus, if an image forming operation is continued while there is the above-described difference, the TD ratio of the developer in the developing device 2 gradually deviates from its initial value. Thus, in order to deal with this issue, the stirring chamber 211 of the developing device 2 is provided with an inductance sensor 26. The control section 100 determines the TD ratio of the developer in the developing device 2 by detecting the output of the inductance sensor 26. Then, it adjusts the amount by which the replenishment developer is to be supplied from the replenishment developer supplying section 7, based on the obtained TD ratio of the developer in the developing device 2, in order to keep the developer in the developing device 2 stable in TD ratio at a preset level. Next, the amount by which the developing device 2 is replenished with the replenishment developer as the N-th image is formed in a continuous image forming operation, is described.

Referring to FIG. 2, the control section 100 calculates video count value Vc based on the information about the image on the Nth print, and calculates video count replenishment amount Mvc by multiplying the obtained video count value Vc by a coefficient Avc. The video count value Vc is the amount (number) of 1 in a single binary signal in the image formation signals. Thus, the video count value Vc of an image which is 100% (solid image with maximum density) is 1023. The video count value Vc is affected by the image ratio. The coefficient Avc is stored in advance in a ROM 102.

$$Mvc=Vc\times Avc \tag{1}$$

Referring to FIG. 2, the control section 100 computes the converted TD ratio Tdin of the developer, based on the output of the inductance sensor 26, which is obtained when the Nth toner image is formed. Then, it calculates the inductance replenishment amount Min by multiplying the difference between the converted TD ratio Tdin and target TD ratio Tdtgt, by a coefficient Ain. The coefficient Ain is stored in advance in the ROM 102. The target TD ratio is recorded in a RAM 103. It is changeable in value.

$$\mathrm{Min}=(TDtgt-TDin)\times Ain \tag{2}$$

The control section 100 calculates the amount M by which the developing device 2 is replenished with toner when the Nth image is formed, using the following equation (3), in which if the amount M is smaller than zero, the amount M is set to zero (M=0). The third item Mrem on the right side of equation (3) stands for the residual amount of toner, that is, the amount of toner that failed to be delivered when the Nth image was formed. The reason why a certain amount of toner fails to be delivered is as follows. That is, the replenishment developer is delivered to the developing device 2 by the amounts measured in an increment which corresponds to a single full rotation of the toner conveyance bottom screw 72. Therefore, the amount which is less than the equivalency of a full rotation of the toner conveyance bottom screw 72 has to be taken into consideration.

$$M=Mvc+\mathrm{Min}+Mrem \tag{3}$$

The control section 100 calculates the number Brq of times replenishment motor 73 has to be rotated, based on the toner replenishment amount M, with the use of the following equation, in which the incremental replenishment amount T is the amount by which the developing device 2 is replenished with the replenishment developer by a single full rotation of the toner conveyance bottom screw 72. The incremental replenishment amount T is stored in advance in the ROM 102. In this embodiment, the incremental replenishment amount T is set to 0.10 g (T=0.10 g). The portion of the value of the required number of rotations Brg, which is on the right side of the decimal point, is ignored; only the integer portion is used.

$$Brg=M/T \tag{4}$$

The control section 100 calculates the number Bpr of rotations, by which the toner conveyance bottom screw 72 is to be actually rotated for the replenishment, based on the required number Brq of rotations. The calculating method will be described later. When the Nth image is formed, the control section 100 supplies the developing device 2 with the replenishment developer, by activating the replenishment motor 73 for a length of time which is proportional to the number Bpr of rotations.

The above-described residual amount Mrem is calculated based on the number Bpr of rotations of the toner conveyance bottom screw 72, with the use of the following equation.

$$Mrem=M-Bpr\times T \tag{5}$$

By the way, the target TD ratio TDtgt is changeable in value. In this embodiment, in a case where the target TD ratio TDtgt needs to be changed in value, referential test images for density detection are formed on the photosensitive drum 13. Then, they are transferred onto the intermediary transfer belt 81, and are detected by the optical sensor 31. Then, the target TD ratio TDtgt is changed in value based on the result of the detection.

(Sequence for Confirming Residual Toner Amount)

Figure 7:
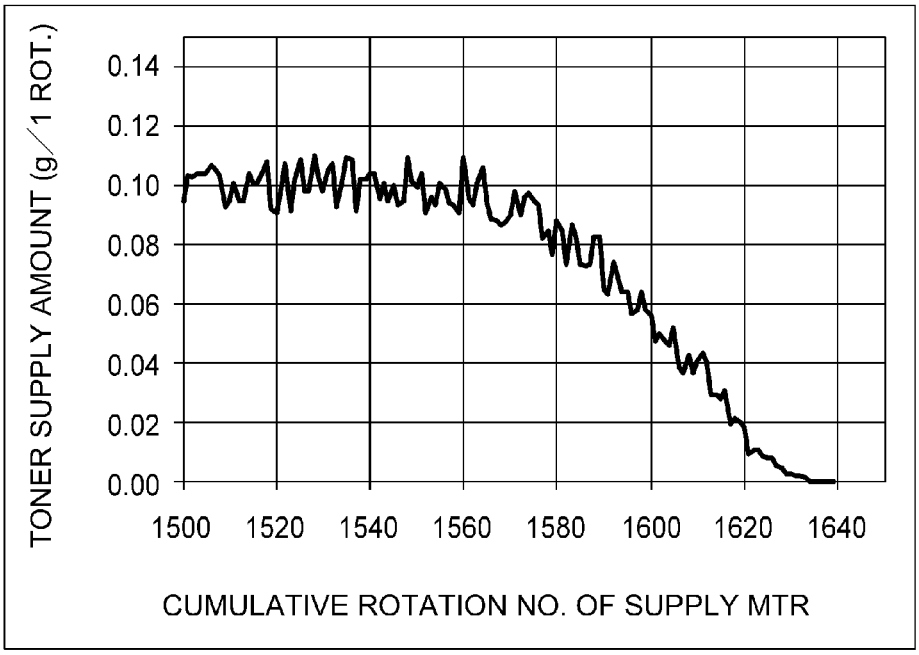
FIG. 7 is a drawing for describing the amount by which replenishment developer is delivered by the replenishment developer supplying section, per rotation of the motor of the section.
Figure 8:
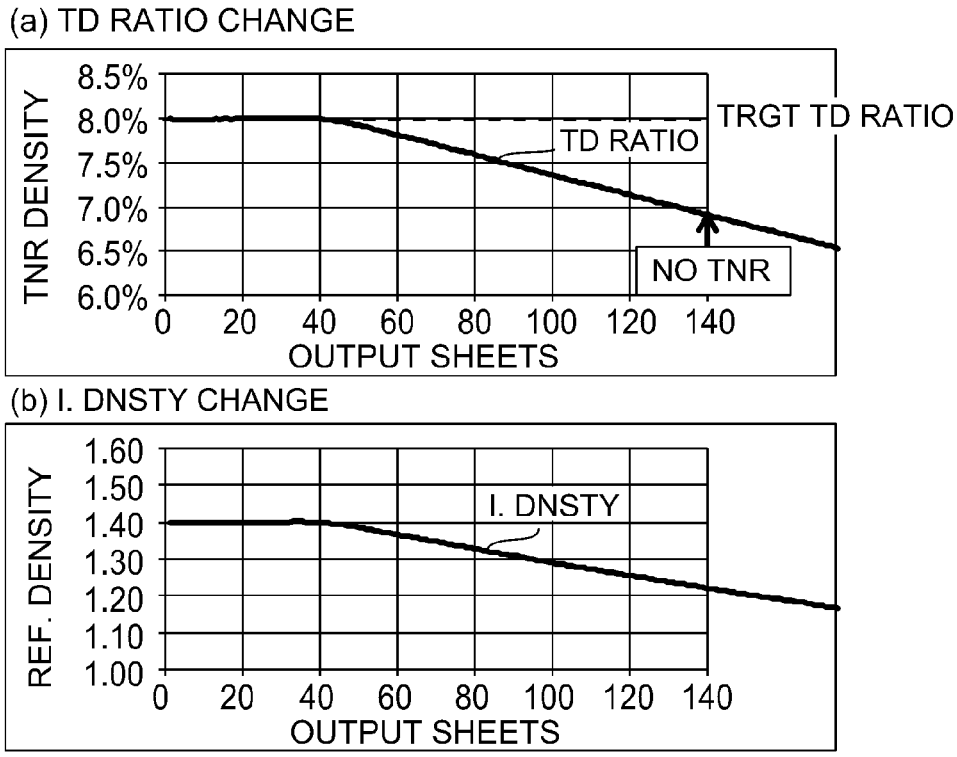
FIG. 8 is a drawing for describing the relationship between the TD ratio and image density when the replenishment developer supplying section is nearly running out of replenishment developer.

FIG. 7 is a drawing for describing the amount by which the developing device 2 is replenished with toner by a single rotation of the replenishment motor of the replenishment developer supplying section 7. FIG. 8 is a drawing for describing the TD ratio and image density toward the end of the life span of the toner bottle 70. More specifically, FIG. 8(*a*) shows the changes in the TD ratio, and FIG. 8(*b*) shows the changes in the image density.

Referring to FIG. 7, immediately before the replenishment developer supplying section 7 runs out of toner, the amount by which toner is delivered by a single rotation of the replenishment motor 73 gradually reduces until it becomes zero. Referring to FIG. 8(*a*), immediately before the replenishment developer supplying section 7 runs out of toner, the amount by which toner is delivered by a single rotation of the replenishment motor 73 becomes insufficient, and therefore, it becomes impossible for the TD ratio of the developer in the developing device 2 to be maintained at a preset level. Consequently, the TD ratio begins to reduce.

As the control section 100 determines that the converted TD ratio Tdin, which is obtained from the output of the inductance sensor 26 has become no more than a preset threshold value (8.0%), it carries out the sequence for confirming the remaining amount of toner (toner amount confirmation sequence). In the toner amount confirmation sequence, the ongoing image forming operation is interrupted for every 10 images. Then, the replenishment motor 73 is driven to replenish the developing device 2 with toner while the developing device driving motor 27 is driven. After the operation for replenishing the developing device 2 with toner is stopped, the control section 100 examines the results of the detection by the inductance sensor 26 to determine whether or not toner is in the replenishment developer supplying section 7.

In the toner amount confirmation sequence, if the control section 100 determines that the relationship between the TD ratio detected when the Nth image is formed and the target TD ratio TDtgt satisfies the following mathematical formula, it determines that the replenishment developer supplying section 7 is out of the replenishment developer (toner).

$$\Delta TD \text{ ratio } (N)=TDin(N)-TDtgt\leq-1.0\% \quad (6)$$

Referring to FIG. 2, the control section 100, which is an example of a demanding section, determines that the result of the detection by the inductance sensor 26 becomes the first threshold value 7% which is smaller than a preset value (8%), it demands the replacement of the toner bottle 70. That is, as the TD ratio of the developer detected by the inductance sensor 26 becomes no more than the first threshold value (7%), the control section 100 displays a message which suggests that the toner bottle 70 is to be replaced, on the control panel 301.

More concretely, referring to FIG. 8(*a*), the control section 100 determines that the converted TD ratio TDin is no more than 7%, it determines that there is no toner in the replenishment developer supplying section 7. Then, it stops the ongoing image forming operation, and demands the replacement of the toner bottle 70 in the replenishment developer supplying section 7, through the control panel 301. That is, it displays a message "Please replace toner bottle", that is, a message which suggests that a user replaces the toner bottle 70 in the replenishment developer supplying section 7, on the display 300. Then, it prevents the image forming apparatus 80 from restarting the interrupted image forming operation.

By the way, in a case where whether or not a developer container is empty is determined based on the output of the inductance sensor 26 as disclosed in Japanese Laid-open Patent Application No. 2005-62848, the ongoing image forming operation is continued for a while until the TD ratio becomes smaller than a preset threshold value. During this period, the TD ratio of the developer in the developing section continues to fall, and therefore, the toner in the developer in the developing section gradually increases in average amount of charge. Consequently, the amount by which toner is adhered to the electrostatic image on the photosensitive drum 13 gradually reduces, eventually therefore causing the image forming apparatus 80 to reduce in image density. That is, in a case where, until the converted TD ratio Tdin falls in value past the normal value (8%) to 7%, the control section 100 does not determine that the replenishment developer supplying section 7 is out of toner, the image forming apparatus 80 gradually reduces in image density while it outputs the last several tens of images before the replenishment developer supplying section 7 runs out of toner. While the converted TD ratio Tdin falls from 8% to 7% as shown in FIG. 8(*a*), the image forming apparatus 80 reduces in image density as shown in FIG. 8(*b*). In a case where the TD ratio slowly reduces as shown in FIG. 8(*a*), the toner slowly increases in average amount of charge, and therefore, the image forming apparatus 80 slowly reduces in image density.

In this embodiment, therefore, during the period in which the converted TD ratio TDin reduces from 8% to 7%, the control section 100 adjusts the exposing device 12 in output, in anticipation of possible decline in image density, based on the output of the inductance sensor 26. By the way, the period in which the converted TD ratio TDin reduces from 8% to 7% is not limited to a period in which the replenishment developer supplying section 7 becomes small in the amount of the replenishment developer, or becomes empty.

(Control in Embodiment 1)

Figure 9:
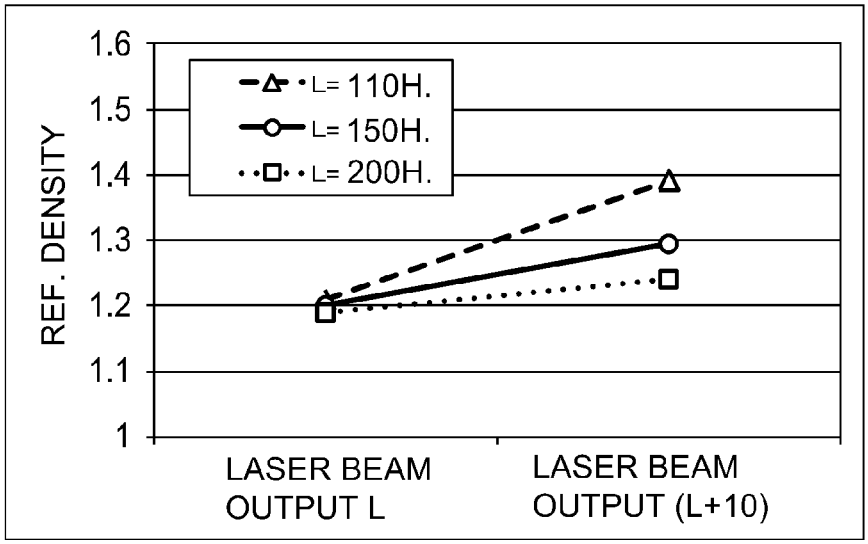
FIG. 9 is a drawing for describing the image density adjustment control sequence in the first embodiment of the present invention.

FIG. 9 is a drawing for describing the control in the first embodiment. Referring to FIG. 2, the exposing device 12 is adjustable in laser output L within a range of 001-256. In the case of the control in the first embodiment, the exposing device 12 is simply increased in the laser output L in proportion to the amount by which the TD ratio measured by the inductance sensor 26 is reduced, in order to compensate for the reduction in the image density. That is, the compensation is made without carrying out the image density adjustment control sequence.

The inductance sensor 26, which is an example of a sensor, detects the information related to the TD ratio, which is the ratio between the toner and carrier in the developer stored in the developing device 2. The control section 100, controls the image formation condition, based on the results of the detection by the inductance sensor 26, in order to change the development contrast Vcont, which is the difference between the potential level of the portion of an image, which is highest in density, and the potential level of the development DC voltage. The image formation condition is the exposure intensity of the exposing device 12, which corresponds to the highest image density. The control section 100 controls the image formation condition in such a manner that the development contrast is smaller when the TD ratio takes the first preset value than when the TD ratio takes the second preset value, which is smaller than the first preset value.

If the developer in the developing device 2 reduces in TD ratio even after the replenishment developer supplying section 7 is activated based on the output of the inductance sensor 26, the control section 100, which is an example of a controlling section, increases the development contrast Vcont in absolute value, by gradually increasing the exposing device 12 in exposure output.

Referring to FIG. 9, in the case of the photosensitive drum 13 which made it possible to achieve the maximum density Dmax of 1.2 through the above-described image density adjustment control sequence, when the laser output L was 150, as the laser output was increased to 160 (L=160), the maximum density Dmax recovered to approximately 1.3. Thus, the image forming apparatus 80 was restored in image density. Thus, an L adjustment coefficient (ΔL/ΔDmax) for restoring the image forming apparatus 80 by 0.1 in maximum density, Dmax is set to 10 (fixed value), and the amount ΔL by which the laser output is to be adjusted is obtained by multiplying the amount ΔDmax by which the maximum density is insufficient, by the L adjustment coefficient. During the period in which the developing device 2 slowly reduces in TD ratio as shown in FIG. 8(*a*), the image forming apparatus 80 reduces in image density as shown in FIG. 8(*b*). In this embodiment, therefore, the exposing device 12 is gradually increased in exposure output.

By the way, an example of a case where a fixed value is used as the value for the L adjustment coefficient is such a case that the sensitivity (relationship between laser output and potential level of exposed point) of the photosensitive drum 13, can be practically overcome by the laser output.

(Comparative Control)

In the case of a comparative control, the image forming apparatus 80 is restored in image density by carrying out the above-described image density adjustment control sequence (Dmax control) to adjust the exposing device 12 in exposure output, during a period in which the converted TD ratio TDin obtained from the output of the inductance sensor 26, reduces from 8% to 7%. More concretely, multiple test patches (toner images) which are different in exposure output (which was increased in steps) are formed. Then, the amount, per unit area, of the toner of each test patch is measured. Then, the exposing device 12 is adjusted in exposure output to make the image forming apparatus 80 (developing device 2) normal in the amount by which toner is adhered to an electrostatic image. As disclosed in Japanese Laid-open Patent Application No. 2005-345961, as the developer in the developing device 2 begins to reduce in TD ratio, the ongoing image forming operation is interrupted, and test patches (toner images) are formed. Then, the test patches are detected by the optical sensor 26. Then, the exposing section is adjusted in exposure output in a manner to counter the image density reduction of the image forming apparatus 80.

However, in the case of the comparative control, the ongoing image forming operation is interrupted to carry out the image density adjustment control sequence. Thus, "down time" occurs to the image forming apparatus 80. That is, the image forming apparatus 80 reduces in productivity. If it is desired to precisely adjust the image forming apparatus 80 in image density, it is necessary to repeat the image density adjustment control sequence a number of times during the period in which the converted TD ratio TDin, reduces from 8% to 7%. Thus, the "down time" frequently occurs, subjecting thereby a user to stress. The time for adjusting the exposing section in exposure output by forming test patches (toner images) becomes downtime, which reduces the image forming apparatus 80 in productivity. The image forming apparatus 80 continues to reduce in image density even while test patches (toner images) are formed. It is impossible to satisfactorily counter the density reduction of the image forming apparatus 80. In comparison, in the first embodiment, test patches are not formed, and therefore, there occur no "downtime". Thus, a user is not subjected to stress.

(Issues in Embodiment 1)

Referring to FIG. 9, the photosensitive drum 13 which provided the maximum density Dmax (=1.2) when the laser output L was 110 (L=110), and the photosensitive drum 13 which provided the maximum density Dmax (=1.2) when the laser output L was 200 (L=200), were subjected to the control in the first embodiment. Further, the two photosensitive drums 13 (L=110; L=200, respectively) were used for image formation with the laser output L set to (L+10). Then, the outputted images were measured in image density.

In the case of the photosensitive drum 13, which provided the maximum density Dmax (=1.2) when the laser output L was set to 150, the maximum density Dmax recovered to roughly 1.3, that is, the image forming apparatus 80 is prevented from becoming unsatisfactory in image density, when the laser output L was set to 160. In comparison, in the case of the photosensitive drum 13, which provided the maximum density Dmax (=1.2) when the laser output L was set to 110, the maximum density Dmax recovered to roughly 1.4 when the laser output L was set to 120. That is, the image forming apparatus 80 became too high in image density. On the other hand, in the case of the photosensitive drum 13 which provided the maximum density Dmax (1.2) when the laser output was set to 200, the maximum density Dmax recovered to roughly 1.25 when the laser output L was set to 210. That is, the image forming apparatus 80 was too low in image density.

That is, the photosensitive drum 13 which provided the maximum density Dmax (1.2) when the laser output L was set to 110, was higher in the sensitivity (amount by which toner is adhered to electrostatic image) to the change in the laser output L than the photosensitive drum 13 which provided the maximum density Dmax (1.2) when the laser output L was set to 150. Therefore, in the case of the former photosensitive drum 13, the amount by which the laser output L is changed has to be set to no higher than 10. On the other hand, in the case of the photosensitive drum 13 which provided the maximum density Dmax when the laser output L was set to 200, its sensitivity (amount by which toner is adhered to electrostatic image) to the amount of change in the laser output L was lower than the latter. Therefore, the amount by which the laser output L is changed has to be set to no less than 10.

Referring to FIG. 3, the relationship between the laser output L and the potential level VL of an exposed point of an electrostatic image is not linear. That is, in a case where the laser output L is high, the amount ΔVcont by which the potential level V1 of a given point of an electrostatic image, which corresponds to an exposed point of the peripheral surface of the photosensitive drum 13, changes as the laser output L is adjusted by an amount ΔL, is smaller. Therefore, the L adjustment coefficient which is used to adjust the exposing device 12 in laser output L to prevent the image forming apparatus 80 from becoming unsatisfactory in image density has to be changed according to the level LD to which the laser output L is set.

Further, as described above, during a period in which the toner bottle 70 becomes nearly empty, and therefore, the developer in the developing device 2 becomes lower in TD ratio, the toner in the developer increases in the amount of charge. Thus, the amount by which toner is adhered to an electrostatic image reduces if the development contrast is kept unchanged. Therefore, the L adjustment coefficient has to be changed in consideration of the effect of the amount of toner charge.

In the first embodiment, the L adjustment coefficient is fixed. Therefore, when the value LD to which the laser output L is set is large, and therefore, the development contrast Vcont, which is necessary to prevent the image forming apparatus 80 from becoming unsatisfactory in image density, is large, it is impossible to precisely adjust the laser output L in response to the amount of reduction of the TD ratio. Further, when the value LD to which the laser output L was set is small, and therefore, the development contrast Dcont, which is necessary to prevent the image forming apparatus 80 from becoming unsatisfactory in image density, is small, it is impossible to precisely adjust the laser output L in response to the amount of reduction of the TD ratio. In addition, the changes which occur to the amount of charge of the toner in the developer during the period in which the toner bottle 70 becomes nearly empty and therefore, the developer becomes lower in the TD ratio, is not taken into consideration.

In the second embodiment, therefore, the amount by which the exposing device 12 is to be adjusted in exposure output based on the output of the inductance sensor 26 is obtained based on the data obtained from the last image density adjustment control sequence, that is, the one carried out before the converted TD ratio Tdin fell below 8%. That is, the amount (large or small) of the amount of toner charge is predicted based on the value of the laser output L, which was set in the immediately preceding image density adjustment control sequence. Then, how the laser output L is to be changed in value is decided in consideration of the relationship between the amount of the laser output L and the potential level VL of a given point of an electrostatic image which corresponds to an exposed point of the peripheral surface of the photosensitive drum 13.

<Embodiment 2>

(Exposure Adjustment Coefficient)

Figure 10:
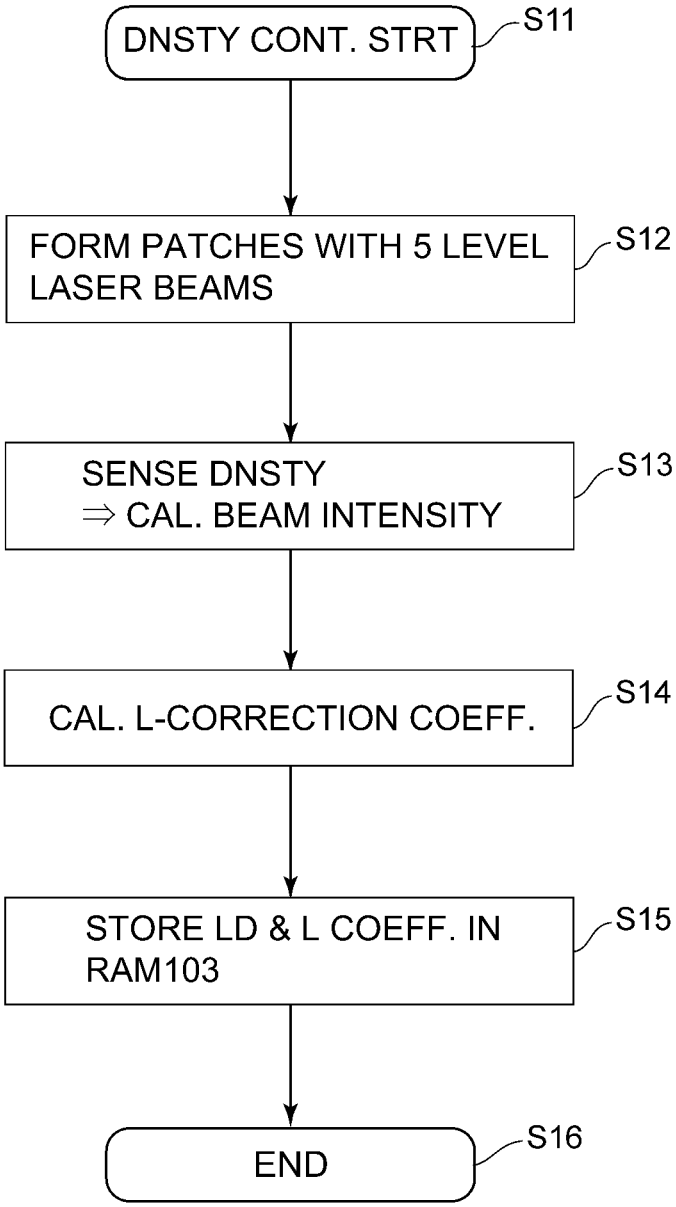
FIG. 10 is a flowchart of the image density adjustment control sequence in the second embodiment of the present invention.
Figure 11:
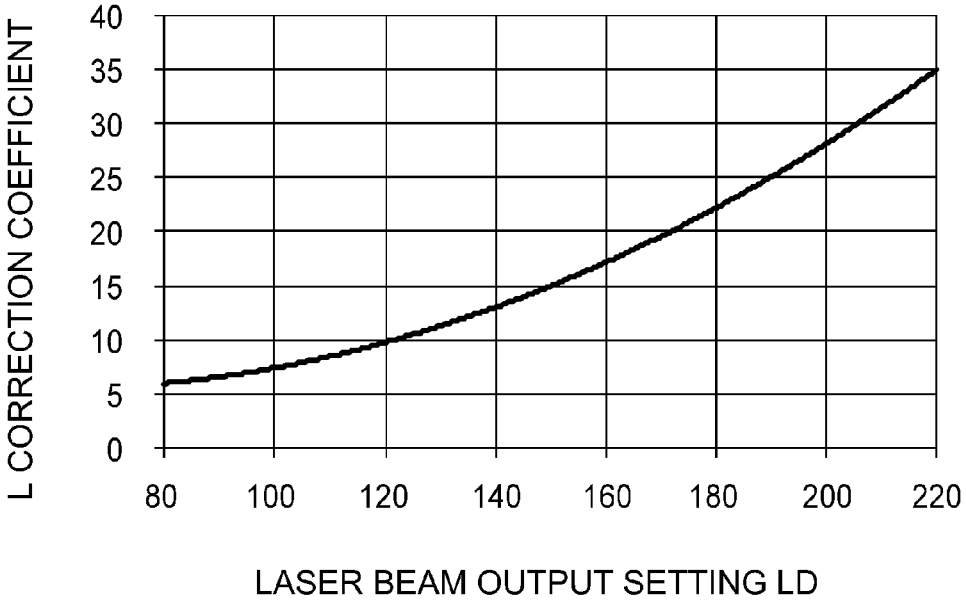
FIG. 11 is a drawing for describing the relationship between the laser output setting and exposure amount adjustment coefficient.

FIG. 10 is a flowchart of the image density adjustment control sequence in the second embodiment. FIG. 11 is a drawing for describing the relationship between the laser output setting and exposure amount adjustment coefficient.

Referring to FIG. 10 along with FIG. 2, the control section 100 starts the image density adjustment control sequence for every 300 images (S11).

The control section 100 forms five test patches (toner images) which are different (varied in steps) in the strength L of laser output (S12). Then, it detects the test patches with the use of the optical sensor 31, and calculates the amount LD to which the laser output L is to be set (S13).

After the detection of the test patches (toner images), the control section 100 sets the laser output value LD and L adjustment coefficient, based on the results of the detection (measurement) by the optical sensor 31, as shown in FIG. 8 (S14).

The control section 100 sets the L adjustment amount LD, based on the TD ratio of the developer detected by the inductance sensor 26, with reference to the relationship between the laser output L (LD) and L adjustment coefficient, which is shown in FIG. 11.

The control section 100 records the laser out L, and the L adjustment coefficient related to the laser output L in the RAM 103 (S15).

The control section 100 ends the image density adjustment control sequence, and allows the image forming apparatus 80 to restart the interrupted image forming operation (S16).

Referring to FIG. 11, the L adjustment coefficient by which the laser output L has to be changed to counter the amount by which the image forming apparatus 80 is reduced in image density as the developer in the developing device 2 reduces in the TD ratio by 1% when the laser output L of the exposing device 12, is an amount by which the setting LD has to be changed. That is, the L adjustment coefficient is the ratio between the amount of change in the laser output L and the amount of change in the image density. The L adjustment coefficient is determined in consideration of the relationship between the amount of toner charge (large or small) when the laser output L is LD, and the relationship between the laser output L and the potential level VL of a given point of an electrostatic image, which corresponds to an exposed point of the peripheral surface of the photosensitive drum 13.

If it is necessary to counter the predictable amount of decline of the image density which occurs as the developer reduces by 1% in TD ratio when the laser output L is 150 (LD=150), the laser output L is increased by 15 to 165 (LD=150+15). If it is necessary to counter the predictable amount of decline of the image density which occurs as the developer reduces by 1% in TD ratio when the laser output L is 110 (LD=110), the laser output L is increased by 8 to 118 (LD=110+8).

For the purpose of canceling the amount by which the image forming apparatus 80 reduces in image density as the TD ratio reduces by 1%, the laser is increased by 28 in output L to 228 (LD=228). When the laser output L is large (LD is large), a given point of the resultant electrostatic image, which corresponds to an exposed point of the peripheral surface of the photosensitive drum 13, is low in potential level (VL). Thus, the development contrast Vcont which is necessary for the image forming apparatus 80 to output images which are proper in density is likely to be large. Referring to FIG. 9, in a case where the development contrast Vcont which is necessary to ensure that the image forming apparatus 80 outputs images which are proper in density is large, it is necessary for the amount by which the development contrast Vcont, which is necessary to change the image forming apparatus 80 in image density, to be large. In order to increase the amount by which the development contrast Vcont is adjusted, the amount by which the laser has to be adjusted in output L also has to be increased.

In the second embodiment, the laser is adjusted in output L in such a manner that the amount by which the development contrast Vcont is changed as the developer reduces in the TD ratio by 1% relative to the target TD ratio when the laser output L is 200 (LD=200) becomes larger than when the laser output L is 150 (LD=150).

Referring to FIG. 11, the amount by which the laser output L needs to be adjusted to prevent the image forming apparatus 80 from becoming unsatisfactory in image density, can be correctly grasped, by calculating the L adjustment coefficient, based on the value LD to which the laser output L is set. Therefore, the L adjustment coefficient is a coefficient which is most suitable for adjusting the laser in its output L as the developer reduces in the TD ratio, and therefore, the image forming apparatus 80 reduces in image density.

(Laser Output Adjustment Control)

Figure 12:
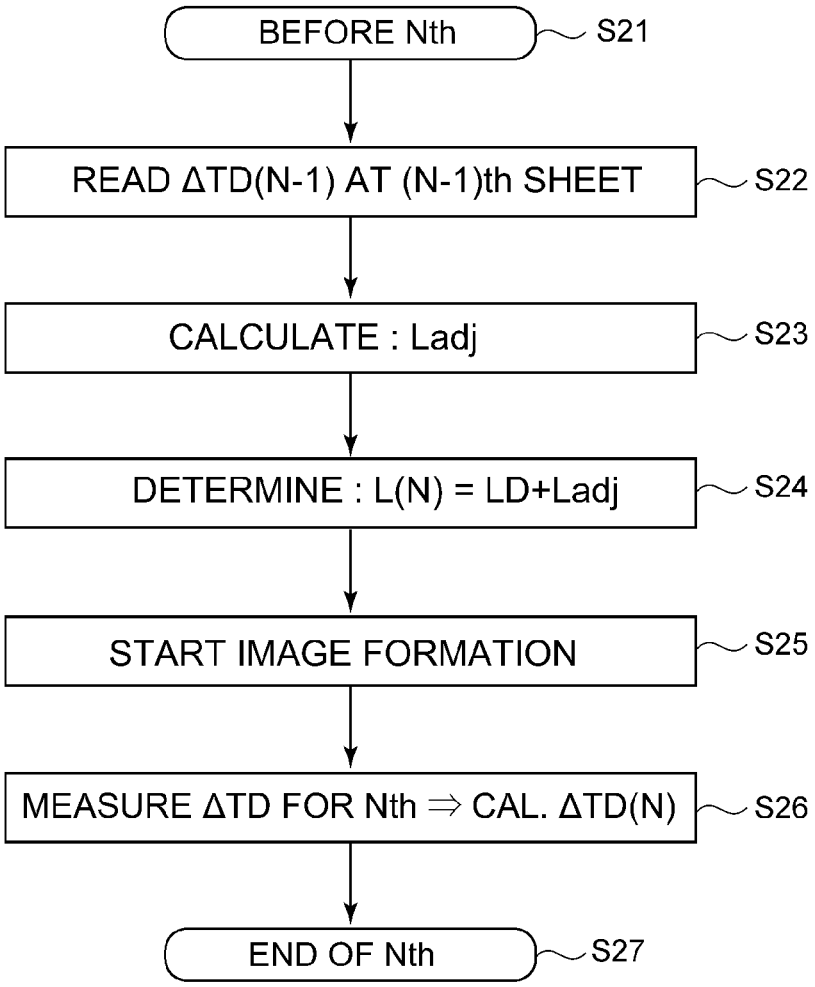
FIG. 12 is a flow chart of the laser output adjustment control sequence in the second embodiment.

FIG. 12 is a flowchart of the laser output adjustment control sequence in the second embodiment. The control section 100 measures the TD ratio of the developer in the developing device 2 during an image forming operation. Then, as the TD ratio falls below the target TD ratio, the control section 100 adjusts the laser in its output L by an amount which corresponds to the amount by which the TD ratio fell, with the use of the L adjustment coefficient obtained through the control sequence, the flowchart of which is in FIG. 10.

Referring to FIG. 12 along with FIG. 2, the control section 100 measures the TD ratio of the developer in the developing device 2 by taking in the output of the inductance sensor 26 for every image. Then, it obtains the amount ΔTD of difference between the measured TD ratio and the target TD ratio TDtgt.

$$\Delta TD = TDin(N-1) - TDtgt$$

The control section 100 obtains the amount ΔTD (N−1) of difference from the TD ratio TDin (N−1) measured during the formation of the (N−1)th image, and records the obtained amount ΔTD in the RAM 103 (S21).

Before the starting of the formation of the Nth image, the control section 100 reads the ΔTD (N−1) and L adjustment coefficient in the RAM 103 (S22).

Then, the control section 100 calculates the laser output adjustment value Ladj by multiplying ΔTD (N−1) by the L adjustment coefficient (S23). During the period in which the developer reduces in the TD ratio TD, ΔTD (N−1) becomes negative. Thus, the laser output adjustment value Ladj is expressed in the form of equation (7).

$$Ladj = (L \text{ adjustment coefficient}) \times (-\Delta TD(N-1)) \quad (7)$$

The control section 100 calculates the amount to which the laser output L (N) is to be set to form the Nth image, by adding the calculated value of the Ladj to the laser output value LD in the RAM 103 (S24).

$$L(N) = LD + Ladj \quad (8)$$

During the formation of the Nth image, the control section 100 exposes the peripheral surface of the photosensitive drum 13 with the laser output L set to the value L(N) calculated with the use of equation (8) (S25).

The control section 100 obtains the amount ΔTD (N) of difference from the TD ratio TDin (N) measured during the formation of the Nth image, and records the amount in the RAM 103 (S26).

As the formation of the Nth image is completed, the control section 100 reduces N to (N−1), and (N+1) to N, and repeats the same control sequence (S27).

In the second embodiment, therefore, the control section 100 can operate the image forming apparatus 80 in the mode, in which the development contrast Vcont is set based on the test patches (toner images) formed with preset timing, as shown in FIG. 2. When the development contrast Vcont set during the preceding control sequence has the second value, which is greater than the first value, the control section 100 increases the amount by which the development contrast Vcont is changed in response to the amount by which the output of the inductance sensor 26 has changed, than when the previously set development contrast Vcont has the first value.

(Effects of Second Embodiment)

Figure 13:
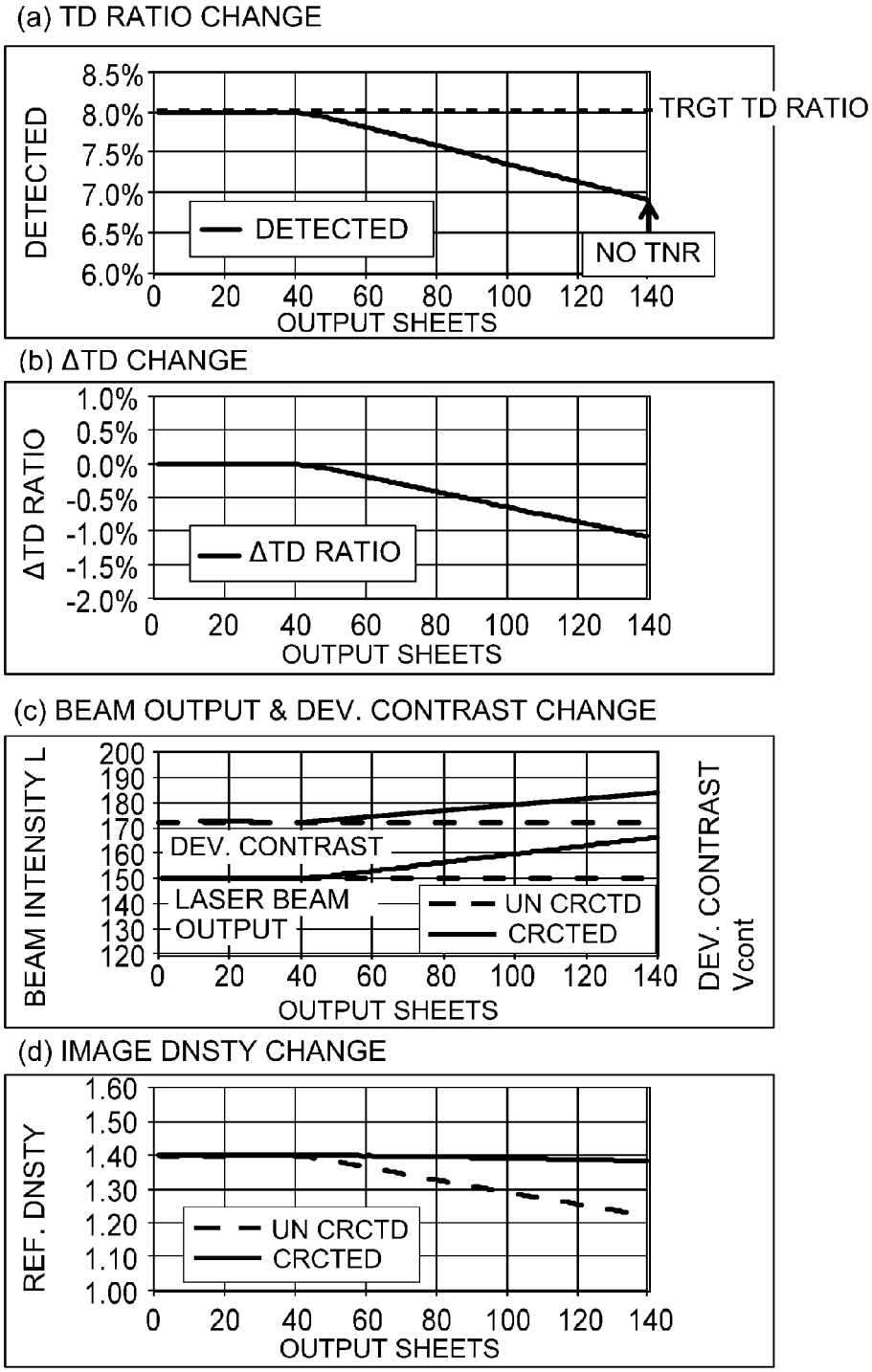
FIG. 13 is a drawing for describing the effects of the second embodiment when the laser output setting is low.

FIG. 13 is a drawing for describing the effects of the first embodiment when the laser output setting is low. FIG. 14 is a drawing for describing the effects of the first embodiment when the laser output setting is high. In FIGS. 13 and 14, (a), (b), (c) and (d) show the changes in the TD ratio, changes in the amount ΔTD of difference, changes in laser output, and changes in the reflection density of the outputted image, respectively.

Referring to FIG. 2, during the period in which the replenishment developer supplying section 7 is nearly running out of the replenishment developer, images which are 10% in image ratio were formed in succession, with the target TD ratio TDtgt and laser output L set to 8.0% and 150 (LD=150), respectively. Referring to FIG. 13(*a*), after the starting of the image forming operation, the TD ratio began to reduce at 40th image. Then, at 140th image, the TD ratio fell below 7%. Therefore, the control section 100 determined that there was no toner in the developer, and prohibited the image forming apparatus 80 to restart the interrupted image forming operation. Referring to FIG. 13(*b*), as the TD ratio began to reduce, the amount ΔTD of difference gradually increased.

Referring to FIG. 13(*c*), the laser of the exposing device 12 was gradually increased in its output L in proportion to the amount ΔTD of difference, as indicated by a solid line. FIG. 13(*d*) shows the reflection density of the image which is highest in density, that is, the image which is 100% in area gradation. Referring to FIG. 13(*d*), as the exposing device 12 was increased in the laser output L, the reduction in the amount by which toner is adhered to an electrostatic image is cancelled as indicated by a solid line. Therefore, the image forming apparatus 80 remains roughly stable in the image density until the control section 100 determines that the developer in the developing device 2 is out of toner. That is, while the image forming apparatus 80 was operated under the condition in which the developing device 2 is adjusted in the laser output L in accordance with the amount of the reduction in the TD ratio, the image forming apparatus 80 was prevented from outputting images which were low in reflection density.

In comparison, when the exposing device 12 was kept stable in the laser output L as indicated by a broken line in FIG. 13(*c*), the amount by which toner is adhered to an electrostatic image gradually decreased, and therefore, the image forming apparatus 80 gradually decreased in the image density, as indicated by a broken line in FIG. 13(*d*). When the image forming apparatus 80 was operated under such condition that the developing device 2 is not adjusted in the laser output L in accordance with the amount of reduction in the TD ratio, the image forming apparatus 80 gradually decreased in reflection image density. The detailed description of FIG. 14 is the same as that of FIG. 13.

However, when the setting LD of the laser output L is 200 as shown in FIG. 14(*c*), the amount by which the laser output L is adjusted is greater as shown in FIG. 13(*c*), than when the setting LD of the laser output L is 150. Therefore, the amount by which the development contrast Vcont has to be adjusted also becomes greater, because the greater the setting LD of the laser output L, the greater the L adjustment coefficient becomes as shown in FIG. 11.

According to the second embodiment, like in a case where the laser output setting LD is 150, even in a case where the laser output setting LD is 200, the image forming apparatus 80 is prevented from suffering from the problem that as the TD ratio reduces, the image forming apparatus 80 reduces in reflection density.

According to the second embodiment, the L adjustment coefficient is made variable. Therefore, even when the laser output setting LD is large, and therefore, the development contrast Vcont which is necessary to prevent the image forming apparatus 80 from becoming unsatisfactory in the image density is large, the developing device 2 can be precisely adjusted in the laser output L according to the amount of decline of the TD ratio. According to the first embodiment, the L adjustment coefficient is made variable. Therefore, even when the laser output setting LD is small, and therefore, the development contrast Vcont which is necessary to change the fixation density is small, the developing device 2 can be precisely adjusted in the laser output L according to the amount of decline of the TD ratio.

According to the second embodiment, the L adjustment coefficient obtained before the TD ratio begins to reduce is used to adjust the developing device 2 in the laser output L. Thus, the developing device 2 can be properly adjusted in the laser output L, without carrying out an additional image density adjustment control sequence after the developing device 2 reduced in the TD ratio. Therefore, it is possible to prevent the image forming apparatus 80 from suffering from the problem that as the developer in the developing device 2 reduces in the TD ratio, the image forming apparatus 80 reduces in image density.

According to the second embodiment, even when the developer container (toner bottle 70) is nearly running out of toner, it is possible to prevent an image forming apparatus from suffering from the problem that an image forming apparatus reduces in image density. Therefore, even when the developer container is nearly out of toner, an image forming apparatus is enabled to continue to output high quality images, without incurring "downtime". Therefore, it is unnecessary that after the TD ratio falls bellow a preset threshold value, the test patches (toner images) or the like are formed to obtain the amount by which the difference between the first and third potential levels is to be adjusted. Therefore, even after it becomes impossible for the replenishment developer to be delivered from the developer container (toner container 70) by a sufficient amount, it is possible to prevent an image forming apparatus from reducing in image density. Therefore, the image forming apparatus is enabled to continuously output high quality images without incurring downtime.

<Embodiment 3>

Figure 15:
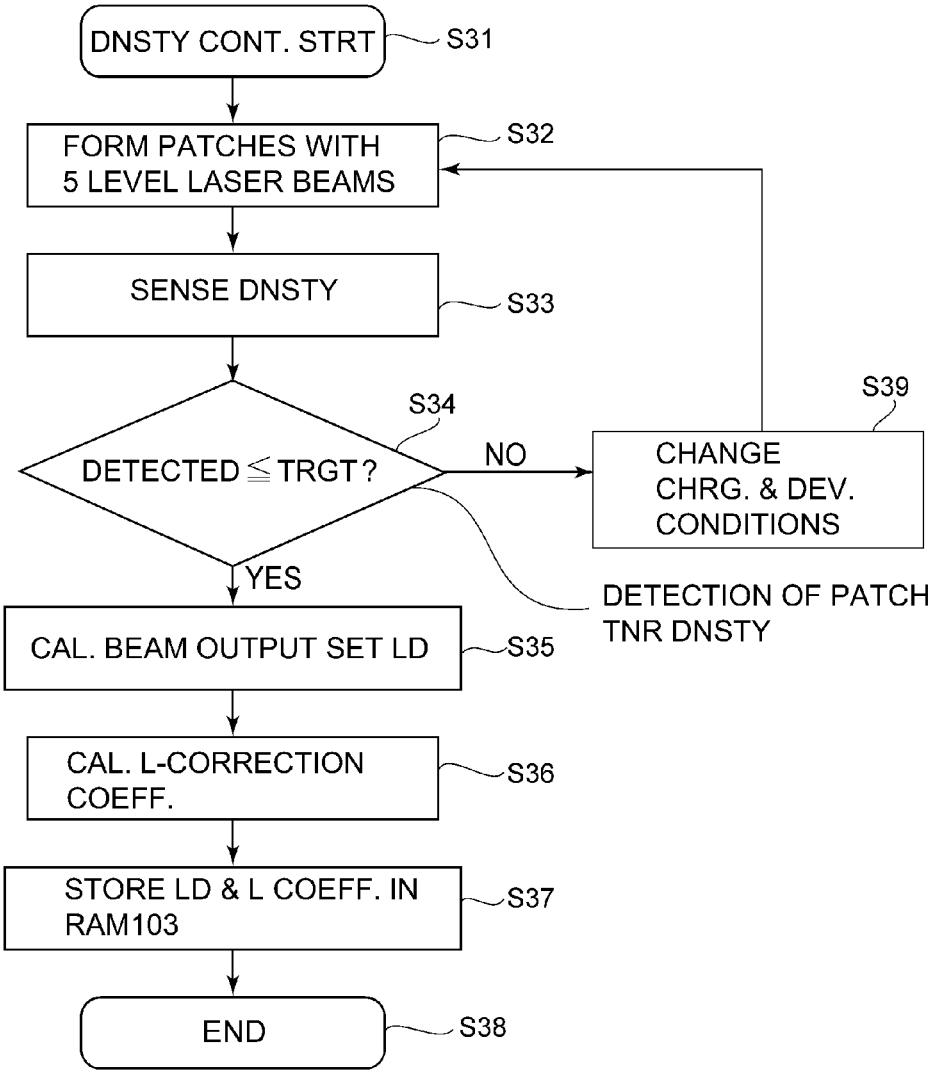
FIG. 15 is a flowchart of the image density adjustment control sequence in the third embodiment of the present invention.
Figure 16:
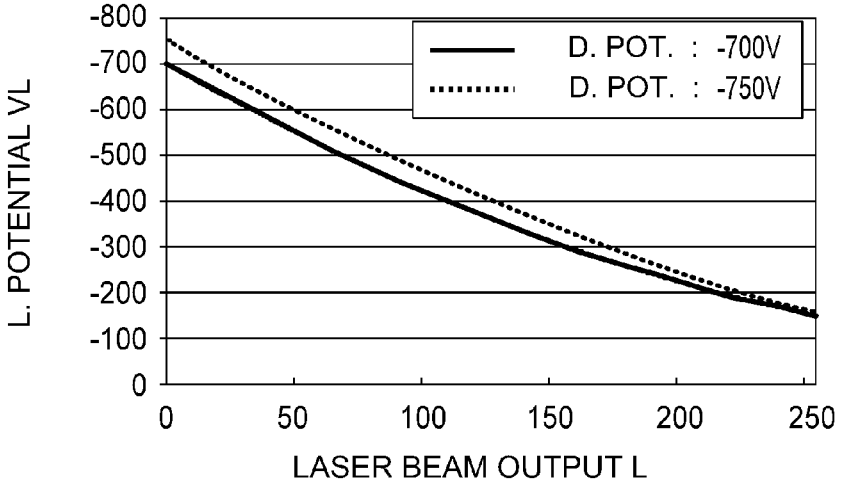
FIG. 16 is a drawing for describing the relationship between the DC voltage to be applied to the charge roller, and the laser output setting.
Figure 17:
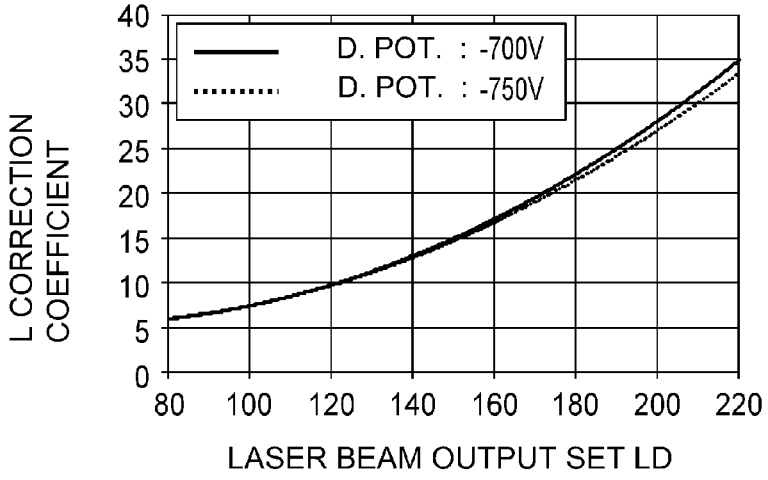
FIG. 17 is a drawing for describing the relationship between the laser output setting and coefficient of L adjustment.

FIG. 15 is a flowchart of the image density adjustment control sequence in the third embodiment of the present invention. FIG. 16 is a drawing for describing the relationship between the DC voltage to be applied to the charge roller, and laser output setting. FIG. 17 is a drawing for describing the relationship between the laser output setting and L adjustment coefficient.

Referring to FIG. 10, in the second embodiment, if the laser output L is set to a value LD which is close to the top end of the laser output range, there will be left little room to increase the laser output L in order to prevent an image forming apparatus from becoming unsatisfactory in image density, as the developer in the developing device 2 reduces in the TD ratio. In the third embodiment, therefore, in a case where the laser output L may be set to a value LD which is greater than a preset value, the potential level to which the photosensitive drum 13 is to be charged is increased in absolute value, in order to prevent the laser output L from being set to the value LD which is close to the top end of the laser output range. Otherwise, the image density adjustment control sequence and laser output adjustment control sequence in this embodiment are the same as those in the first embodiment. Thus, the portions of the third embodiment, which are similar to the counterparts in the first embodiment are not described here in order not to repeat the same description.

Referring to FIG. 15 along with FIG. 2, the control section 100 interrupts the ongoing image forming operation for every 300 images, and begins the image density adjustment control sequence (S31).

The control section 100 forms five test patches (toner images) which are different in the strength L of laser output (S32). In the third embodiment, the five test patches were formed with the laser output L set to 80, 115, 150, 185 and 220, one for one. Then, the control section 100 detects the test patches with the use of the optical sensor 31 (S33).

If the reflection density of the test patch formed with the laser output L is set to 220, or the highest intensity among the five levels of intensity, is greater than the target value (No in S34), the control section 100 changes the charging condition and developing condition, and forms the test patches for the second time (S32). That is, if the exposing device 12 used for image formation is greater in exposure strength than a preset value, the control section 100 sets the exposure strength of the exposing device 12 used for image formation to be no more than a preset value, by changing at least one of the preset charge potential level and development DC potential level. Then, the control section 100 changes the relationship between the change in the result of the detection by the optical sensor 31, and the amount by which the development contrast is to be changed in response to the change in the amount of the output of the optical sensor 31.

In a case where the output of the optical sensor 31 is no more than the target value when the test patch (toner image) formed with the laser output L set to 220 is detected by the optical sensor 31 (Yes in S34), the control section 100 calculates the value LD to which the laser output L is to be set (S35).

After the detection of the test patch, the control section 100 determines the L adjustment coefficient for the laser output setting LD, based on the results of measurement, shown in FIG. 8 (S36).

The control section 100 records the laser output setting LD, and corresponding L adjustment coefficient, in the RAM 103 (S37).

The control section 100 ends the image density adjustment control sequence, and allows the image forming apparatus to restart the interrupted image forming operation (S38).

In a case where the test patches (toner images) are formed, with the laser beam intensity set to a value which is close to the top end of the laser beam intensity range, and the output of the optical sensor 31 is greater than the target value, the value LD to which the laser output L of the exposing device 12 is set to adhere a preset amount of toner to an electrostatic image, comes close to the top end of the laser beam intensity range. Consequently, there is left little room to increase the developing device 2 in laser beam intensity L from the value LD, in order to increase the amount by which toner is adhered to an electrostatic image.

Therefore, the value LD to which the laser output L is set is lower by altering the charging condition and developing condition in the direction to increase the amount by which toner is adhered to an electrostatic image, in order to provide room for increasing the amount by which toner is adhered to an electrostatic image by increasing the laser output L. Referring to FIG. 2, the control section 100 increases both the absolute value of the DC voltage to be applied to the development sleeve 232 of the developing device 2, and the absolute value of the DC voltage to be applied to the charge roller of the charging device 11. Thus, it is ensured that even if the laser output L is small, it is possible to increase the development contrast Vcont in order to adhere toner to an electrostatic image by a proper amount.

More concretely, it was made possible to change the DC voltage to be applied to the charge roller within a range of −700 V--800 V, and to change the DC voltage to be applied to the development sleeve in a range of −550 V--650 V. More specifically, the DC voltage to be applied to the charge roller was changed from −700 V to −750 V, and the DC voltage to be applied to the development sleeve was changed from −550 V to −600 V.

Referring to FIG. 16, as the DC voltage to be applied to the charge roller was changed from −700 V to −750 V, the difference between the potential level VL of a given exposed point of an electrostatic image and the potential level VD of a given unexposed point of the photosensitive drum 13 widened. Further, as the DC voltage to be applied to the development sleeve 232 was changed from −550 V to −600 V, the development contrast increased, and therefore, the amount by which toner was adhered to an electrostatic image increased, even though the laser beam output L was left unchanged.

By the way, referring to FIG. 16, in the third embodiment, the potential level VD to which the peripheral surface of the photosensitive drum 13 was charged changed in value. Thus, when the L adjustment coefficient is calculated (S36 in FIG. 15), the relationship between the laser output L and the potential level VL of a given exposed point of an electrostatic image is different (changed). Thus, the relationship between the value LD to which the laser output L is set and the L adjustment coefficient is slightly different.

Therefore, the control section 100 changes the relationship between the laser output setting LD and L adjustment coefficient, according to the potential level VD of the unexposed charged points of the peripheral surface of the photosensitive drum 13, as shown in FIG. 17. The table (data) which shows these relationship is also stored in the ROM 102.

According to the third embodiment, in the image density adjustment control sequence, at least one of the conditions under which the photosensitive drum 13 is to be charged by the charging device 11, and the condition under which an electrostatic image is developed by the developing device 2, is changed, in order to leave some room to increase the exposing device 12 in exposure output to prevent the image forming apparatus 80 from decreasing in image density due to the decrease in the TD ratio. In a case where the image density adjustment control sequence makes the laser output setting LD greater than a preset value, the control section 100 changes other image formation conditions than the charging condition and developing condition, to cause the laser output setting LD to remain to be no more than a preset value.

According to the third embodiment, it is possible to prevent the laser output from reaching close to 255, which is near the top end of the laser output range, during the image density adjustment control sequence. Therefore, it is possible to keep the image forming apparatus 100 stable in the image density, at a necessary level, by increasing the developing device 2 in the laser output L, as the developer in the developing device 2 reduces in the TD ratio. Further, even in a case where there is no room for increasing the developing device 2 in the laser output L, it is possible to provide room for controlling the developing device 2 in laser output L to prevent the image forming apparatus from becoming unsatisfactory in image density.

<Embodiment 4>

Figure 18:
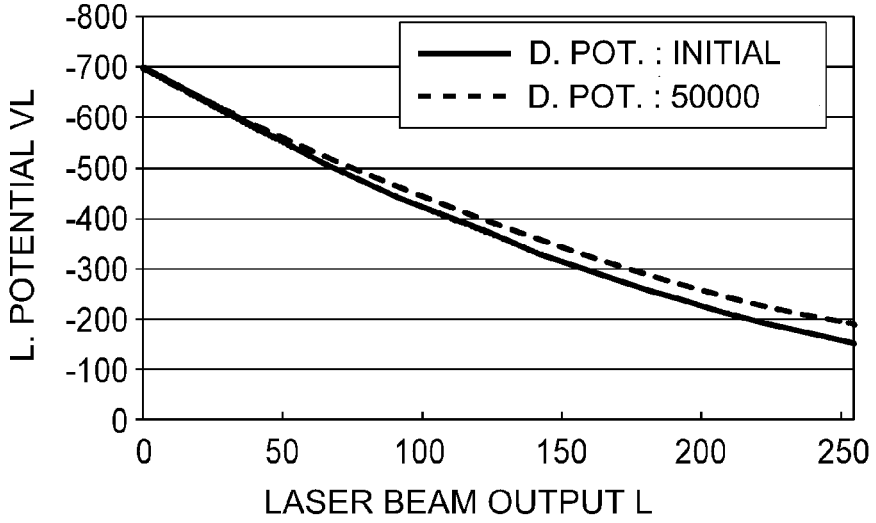
FIG. 18 is a drawing for describing the relationship between the reduction in the sensitivity of a photosensitive drum, and the resultant changes in the potential level of a given point of an electrostatic image, which corresponds to an exposed point of the peripheral surface of the photosensitive drum.
Figure 19:
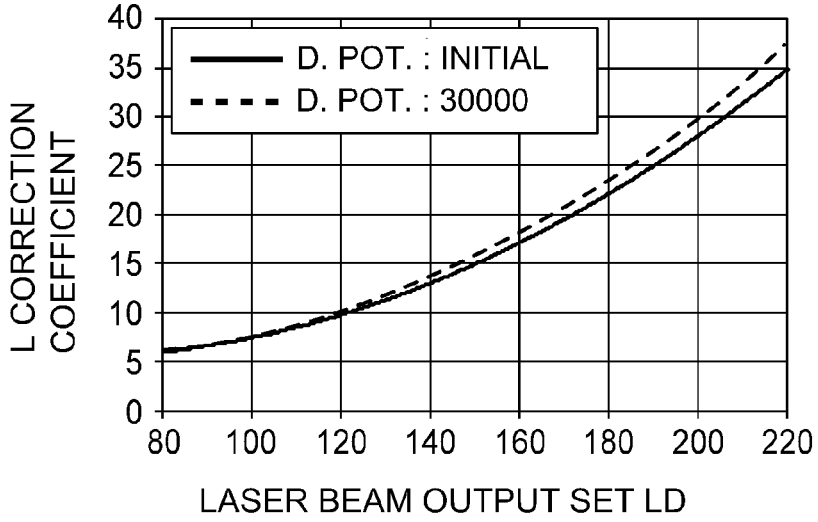
FIG. 19 is a drawing for describing how the L adjustment coefficient is set in consideration of the reduction in the sensitivity of the photosensitive drum.

FIG. 18 is a drawing for describing the change which occurs to the level to which a given point of the charged peripheral surface of the photosensitive drum 13 reduces in the amount of charge as the photosensitive drum 13 reduces in sensitivity. FIG. 19 is a drawing for describing the L adjustment coefficient settings calculated in consideration of the reduction in the sensitivity of the photosensitive drum 13.

In the second and third embodiments, when the relationship between the laser output setting LD, and L adjustment coefficient, is set in advance, the relationship between the laser output L and the potential level VL of a given exposed point of an electrostatic image is referenced.

As the photosensitive drum 13 reduces in the sensitivity to a beam of laser light, due to its age, the relationship between the laser output setting LD and development contrast deviates slightly. In the fourth embodiment, therefore, the relationship between the laser output setting LD and the L adjustment coefficient is adjusted according to the cumulative usage of the photosensitive drum 13, in terms of the cumulative number of images formed with the use of the photosensitive drum 13.

Referring to FIG. 18, after the formation of the 5000th image, the relationship between the laser output L and the potential level VL of a given exposed point of an electrostatic image is different from that right after the photosensitive drum 13 is used for the first time. That is, after the formation of the 50000th image, the photosensitive drum 13 is less sensitive to a beam of laser light than when the photosensitive drum 13 is used for the first time. In the fourth embodiment, therefore, in order to deal with this issue, after the formation of the 50000th image, the relationship between the laser output setting LD and the L adjustment coefficient is changed from that when the photosensitive drum 13 is brand-new, as shown in FIG. 19.

There is recorded in the ROM 102, a table to be used for changing the relationship between the laser output setting LD and the L adjustment coefficient, according to the potential level of the photosensitive drum 13 and the cumulative number of images formed by the photosensitive drum 13. In the fourth embodiment, when the Nth image is formed, the control section 100 sets the laser output L higher than when the (N+α)th image is formed.

By the way, in a case where the sensitivity of the photosensitive drum 13 to a beam of laser light is affected by an environment, the relationship between the laser output setting LD and the L adjustment coefficient may be changed according to the environmental condition, with the use of the relationship between the laser output L and the potential level VL of an exposed point of an electrostatic image. In the fourth embodiment, when the environment in which the image forming apparatus (photosensitive drum 13) is used is such that the temperature has the first value, and the humidity has the first value, the control section 100 sets the laser output L higher than when the environment is such that the temperature has the second value and the humidity has the second value.

<Embodiment 5>

In the second, third and fourth embodiments, as the developer in the developing device 2 reduced in the TD ratio, the control section 100 changed the developing device 2 in the laser output L to enable the image forming apparatus 80 to continue to output images which are proper in density. That is, the control section 100 changed the development contrast Vcont by changing the level VL to which the potential level V of a given point of the charged area of the peripheral surface of the photosensitive drum 13 reduces in absolute value as it is exposed. The primary reason why this was done is that it is the laser output L that is easy to change while the image forming apparatus 80 is being used for image formation.

However, in the case of the present invention, it is important that during the period in which the developer in the developing device 2 reduces in the TD ratio, the development contrast Vcont is increased to a proper level for absorbing the increase in the toner charge. Whether the increase in the toner charge is absorbed by the change in exposure is not important. That is, the development contrast Vcont may be adjusted by changing the charging condition and developing condition, instead of the laser output L.

<Embodiment 6>

In the sixth embodiment, in a case where the result of the detection by the inductance sensor 26 indicates that the converted TD ratio Tdin is smaller than a preset threshold value of 7.6% which is smaller than a preset value of 8%, the control section 100 changes the development contrast Vcont, based on the difference between the result of the detection by the inductance sensor 26 and the preset threshold value 7.6%. The control section 100 controls the image formation condition in such a manner that, during the period in which the result of the detection by the inductance sensor 26 reduces from the second threshold value 7.6% to the first threshold value 7%, the development contrast Vcont gradually increases.

More concretely, during the period in which the result of the detection by the inductance sensor 26 reduces from the second threshold value 8.0% to 7.6%, the control section 100 does not change the exposing device 12 in the laser output L. Then, during the period in which the result of the detection by the inductance sensor 26 reduces past 7.6%, the control section 100 increases the exposing device 12 in the exposure output, according to the difference between the measured TD ratio of the developer and preset value 8%, as in the first embodiment.

According to the control in the sixth embodiment, it is possible to avoid the problem that when the TD ratio obtained from the result of the detection by the inductance sensor 26 is different from the actual one because of the sporadic change in the TD ratio of the developer, the developing device 2 is erroneously changed in the laser output L. That is, the control section 100 changes the developing device 2 in the laser output L only when the developer actually reduced in the TD ratio. Therefore, it is possible to avoid the problem that the developing device 2 is frequently changed in the laser output L before the toner bottle 70 becomes nearly empty.

<Miscellanies>

The present invention can be embodied in other forms of apparatuses which are entirely or partially different in structure from those described above, as long as the apparatuses are designed so that during the period in which the replenishment developer supplying section 7 is nearly running out of toner, their developing device is gradually increased in development contrast in order to prevent the apparatuses from becoming unsatisfactory in image density.

The present invention is applicable to any developing device, any process cartridge, and any image forming apparatus, which uses two-component developer, regardless of their charging method, transferring method, and fixing method. The measurements, materials, and shapes of the structural components of the image forming apparatuses 80, and the positional relationship among the components, disclosed in the first to third embodiments, are not intended to limit the present invention in scope unless specifically noted. In the foregoing, only the portions of an image forming apparatus, which are related to the formation and transfer of a toner image, were described. However, the present invention is applicable to various apparatuses other than the above-described ones. For example, it is applicable to various printing machines, copying machines, facsimile machines, multifunction machines, etc., which are combinations of devices, equipments, and casing (housing), in addition to the above-described portions.

In the first embodiment, development contrast was increased by increasing the exposing device in exposure output, while keeping the charging device and developing device the same in operational condition. However, all that is necessary is to increase the development contrast by controlling one of the charging device, exposing device, and developing device. For the purpose of detecting the TD ratio, various means, the output of which is proportional to the TD ratio of the developer in the developing device, can be used. For example, a density sensor, a color sensor, a reflection light amount sensor, and the like are usable in addition to the inductance sensor 26.

The application of the present invention is not limited to an image forming apparatus, the toner bottle of which for replenishing the developing device with toner is independent from the developing device, and which is structured so that whether or not the toner bottle is empty is determined based on the value of the TD ratio sensor disposed in the developing device. That is, the present invention is also applicable to an image forming apparatus structured so that the toner bottle is fixed to the developing device, or the toner bottle is fixed to the frame of the image forming apparatus.

According to the present invention, as the developer in the developing device in an image forming apparatus reduces in the TD ratio, the apparatus can be prevented from becoming unsatisfactory in image density, based on the result of the detection by an induction sensor or the like, and the information obtainable during the image density adjustment control sequence, regardless of whether there is toner in the toner bottle, or not.

According to the present invention, an image forming apparatus can be prevented from becoming unsatisfactory in image density, by the adjustment of the laser output L, with no relation to whether or not the toner bottle is empty. Thus, the image forming apparatus may be prevented from becoming unsatisfactory in image density, in response to the TD ratio reduction which is detected before whether or not the toner bottle is out of toner is detected.

In the case of an image forming apparatus in accordance with the present invention, as the developer in the developing section of the apparatus reduces in the TD ratio, which is the ratio between the toner and carrier in the developer, reduces, it is possible to adjust the apparatus for the image density reduction attributable to the reduction in the TD ratio, by adjusting the development contrast in anticipation of the occurrence of the TD ratio reduction. Therefore, even in a case where the developer in the developing section reduces in the TD ratio even though the replenishment developer supplying section is replenishing the developing section with replenishment developer, it is possible to prevent the image forming apparatus from becoming insufficient in image density.

INDUSTRIAL APPLICABILITY

According to the present invention, it is possible to provide an image forming apparatus which does not reduce in image density when the developer in the developing section reduces in the TD ratio even though the developer supplying section is in action to replenish the developing section with replenishment developer.

The invention claimed is:

1. An image forming apparatus comprising:

an image bearing member configured to carry an image;

a developing device configured to develop a latent image formed on said image bearing member with a developer including toner and carrier;

a toner content sensor configured to detect a ratio of the toner to the developer in said developing device;

a toner container configured to contain the toner to be supplied to said developing device;

an executing portion configured to execute an operation in a first toner supplying mode for supplying the toner from said toner container into said developing device when the ratio indicated by an output of said toner content sensor is in a predetermined range and to execute an operation in a second toner supplying mode for interrupting an image forming operation and for supplying the toner from said toner container into said developing device when the ratio indicated by the output of said toner content sensor is lower than the predetermined range;

a notifying portion configured to notify necessity for exchange of said toner container when the ratio indicated by the output of said toner content sensor reaches a set level lower than the predetermined range; and a controller configured to control an image forming condition so as to change, on the basis of the output of said toner content sensor, a development contrast which is a potential difference between an image portion potential of a maximum image density in the latent image and a development DC bias potential applied to said developing device, wherein said controller sets the development contrast at a level higher than that when the ratio is in the predetermined range, at least in part of a period from when the ratio indicated by the output of said toner content sensor becomes lower than the predetermined range to when the ratio indicated by the output of said toner content sensor reaches the set level.

2. An apparatus according to claim 1, wherein said controller increases the development contrast by increasing an exposure amount.

3. An apparatus according to claim 1, wherein the set level is a first set level, said controller sets the development contrast at a level higher than that when the ratio is in the predetermined range in part of a period from a second set level of the ratio indicated by the output of said toner content sensor lower than the predetermined range and higher than the first set level to the ratio indicated by the output of said toner content sensor reaching the first set level.

4. An apparatus according to claim 3, wherein in a period from when the ratio indicated by the output of said toner content sensor becomes lower than the predetermined range to when the ratio indicated by the output of said toner content sensor reaches the second set level, said controller does not change the development contrast on the basis of the output of said toner content sensor.

5. An apparatus according to claim 1, wherein when the ratio indicated by the output of said toner content sensor is in the predetermined range, said controller does not change the development contrast on the basis of the output of said toner content sensor.

6. An apparatus according to claim 1, wherein said controller sets the development contrast at a level higher than that when the ratio is in the predetermined range at least in part of a period from exchange of said toner container to when the ratio indicated by the output of said toner content sensor reaches the predetermined range.

7. An apparatus according to claim 1, wherein the image portion potential of a maximum image density in the latent image is a potential of an area exposed to light.

8. An apparatus according to claim 1, wherein said toner content sensor comprises an inductance sensor.

9. An image forming apparatus comprising:

an image bearing member configured to carry an image;

a developing device configured to develop a latent image formed by exposing, to light, said image bearing member electrically charged, with a developer including toner and carrier;

a toner content sensor configured to detect a ratio of the toner to the developer in said developing device;

a toner container configured to contain the toner to be supplied to said developing device;

an executing portion configured to execute an operation in a first toner supplying mode for supplying the toner from said toner container into said developing device when the ratio indicated by an output of said toner content sensor is in a predetermined range and to execute an operation in a second toner supplying mode for interrupting an image forming operation and for supplying the toner from said toner container into said developing device when the ratio indicated by the output of said toner content sensor is lower than the predetermined range; and a controller configured to control an image forming condition so as to change, on the basis of the output of said toner content sensor, a development contrast which is a potential difference between an image portion potential of a maximum image density in the latent image and a development DC bias potential applied to said developing device, wherein said controller sets the development contrast at a level higher than that when the ratio is in the predetermined range, at least in part of a period when the ratio indicated by the output of said toner content sensor becomes lower than the predetermined range.

10. An apparatus according to claim 9, wherein said controller increases the development contrast by increasing an exposure amount.

11. An apparatus according to claim 9, further comprising a feeding portion for feeding the toner from said toner container to said developing device, said feeding portion lacking a sensor for sensing a toner content of the developer in said feeding portion.

12. An apparatus according to claim 11, further comprising a notifying portion configured to notify necessity for exchange of said toner container when the ratio indicated by the output of said toner content sensor reaches a set level lower than the predetermined range.

13. An apparatus according to claim 12, wherein the set level is a first set level, wherein said controller sets the development contrast at a level higher than that when the ratio is in the predetermined range in part of a period from a second set level of the ratio indicated by the output of said toner content sensor lower than the predetermined range and higher than the first set level to the ratio indicated by the output of said toner content sensor reaching the first set level.

14. An apparatus according to claim 13, wherein in a period from when the ratio indicated by the output of said toner content sensor becomes lower than the predetermined range to when the ratio indicated by the output of said toner content sensor reaches the second set level, said controller does not change the development contrast on the basis of the output of said toner content sensor.

15. An apparatus according to claim 12, wherein said toner content sensor comprises an inductance sensor.

16. An apparatus according to claim 9, wherein when the ratio indicated by the output of said toner content sensor is in the predetermined range, said controller does not change the development contrast on the basis of the output of said toner content sensor.

17. An apparatus according to claim 9, wherein said controller sets the development contrast at a level higher than that when the ratio is in the predetermined range, at least in part of a period from exchange of said toner container to when the ratio indicated by the output of said toner content sensor reaches the predetermined range.

18. An apparatus according to claim 9, wherein the image portion potential of a maximum image density in the latent image is a potential of an area exposed to light.

* * * * *